US011727890B2

(12) United States Patent
Choi

(10) Patent No.: US 11,727,890 B2
(45) Date of Patent: Aug. 15, 2023

(54) DISPLAY DEVICES SUPPORTING VARIABLE FRAMES

(71) Applicant: SAMSUNG ELECTRONICS CO., LTD., Suwon-si (KR)

(72) Inventor: Hak-Hun Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/718,730

(22) Filed: Apr. 12, 2022

(65) Prior Publication Data

US 2023/0042768 A1 Feb. 9, 2023

(30) Foreign Application Priority Data

Aug. 6, 2021 (KR) ..... 10-2021-0103840

(51) Int. Cl.
*G09G 3/34* (2006.01)

(52) U.S. Cl.
CPC ..... *G09G 3/3406* (2013.01); *G09G 2310/08* (2013.01); *G09G 2320/0247* (2013.01); *G09G 2320/0626* (2013.01); *G09G 2340/0435* (2013.01)

(58) Field of Classification Search
None
See application file for complete search history.

(56) References Cited

U.S. PATENT DOCUMENTS

| | | | | |
|---|---|---|---|---|
| 10,909,935 | B2 | 2/2021 | Koo et al. | |
| 10,923,044 | B2 | 2/2021 | Koo et al. | |
| 10,923,048 | B2 | 2/2021 | Handa et al. | |
| 2020/0135146 | A1 | 4/2020 | Lee et al. | |
| 2020/0143756 | A1 | 5/2020 | Chen | |
| 2020/0251058 | A1* | 8/2020 | Wu | G09G 3/3406 |
| 2020/0335033 | A1 | 10/2020 | Kim et al. | |
| 2021/0005149 | A1 | 1/2021 | Chen | |

* cited by examiner

*Primary Examiner* — Christopher J Kohlman
(74) *Attorney, Agent, or Firm* — F. Chau & Associates, LLC

(57) ABSTRACT

A display device including: a display panel which includes a plurality of pixels, and outputs image data in an active section of a frame, and does not output image data in a blank section of the frame; and a backlight unit configured to irradiate the display panel with light, wherein a length of the blank section is variable, and the backlight unit is configured to irradiate the display panel with strobe light at the active section, and is configured to irradiate the display panel with a first flat light at the blank section.

20 Claims, 21 Drawing Sheets

DISPLAY DEVICES SUPPORTING VARIABLE FRAMES

CROSS-REFERENCE TO RELATED APPLICATION

This application claims priority under 35 U.S.C. § 119 to Korean Patent Application No. 10-2021-0103840, filed on Aug. 6, 2021 in the Korean Intellectual Property Office, the disclosure of which is incorporated by reference herein in its entirety.

1. Technical Field

The present disclosure relates to a display device that supports a variable frame.

2. Description of the Related Art

A display device is an output device for presentation of information in visual form. In general, a display device displays an image at a constant frame rate of 60 Hz or higher. However, a frame rate of a host that provides data to the display device may not match a frame rate of the display device. For example, the frame rate of the host may be greater than or less than the frame rate of the display device. When the frame rates between the host and the display device do not match, a tearing phenomenon in which a boundary line is output to an image displayed on the display device may occur.

To prevent the tearing phenomenon, the host may change a length of a blank section included in a frame for each frame and provide the data to the display device at a variable frame rate. Accordingly, the display device may display an image in synchronization with the variable frame rate provided from the host such that the tearing phenomenon does not occur.

In general, the backlight unit may use a strobe light that instantaneously irradiates the display panel with light at a certain time at the active section where data is output. However, at a variable frame rate where variable blank sections are present, the backlight unit may not have a constant time interval in which to irradiate the strobe light. Accordingly, the human eye may recognize a flicker from the image that is output from the display panel.

To prevent flicker due to the irregular strobe light at a variable frame rate, the backlight unit may use a flat light which irradiates the display panel with light having constant brightness in both the active section and the variable frame section. However, the flat light may output a blurred image.

SUMMARY

Embodiments of the present disclosure provide a display device that outputs an image which is clear and does not flicker.

According to an embodiment of the present disclosure, there is provided a display device including: a display panel which includes a plurality of pixels, and outputs image data in an active section of a frame, and does not output image data in a blank section of the frame; and a backlight unit configured to irradiate the display panel with light, wherein a length of the blank section is variable, and the backlight unit is configured to irradiate the display panel with strobe light at the active section, and is configured to irradiate the display panel with a first flat light at the blank section.

According to an embodiment of the present disclosure, there is provided a display device including: a display panel including a plurality of pixels; a backlight unit configured to irradiate the display panel with light; a data driver configured to provide a data signal to the display panel; a gate driver configured to provide a gate signal to the display panel; a backlight controller configured to control the backlight unit; and a processing unit configured to receive input data and variable frame synch signal and generate an internal control signal and an output data, wherein the backlight controller is configured to provide the backlight unit with a backlight unit signal having a first current level at an active section of a variable frame, and the backlight controller is configured to provide the backlight unit with a backlight unit signal having a second current level lower than the first current level at a variable blank section of the variable frame.

According to an embodiment of the present disclosure, there is provided a display device including: a display panel including a plurality of pixels; a backlight unit configured to irradiate the display panel with light; a data driver configured to provide a data signal to the display panel; a gate driver configured to provide a gate signal to the display panel; a backlight controller configured to control the backlight unit; and a processing unit configured to receive input data and a variable frame synch signal and generate an internal control signal and output data, wherein the backlight controller is configured to provide the backlight unit with a backlight unit signal having a first duty ratio at an active section of a variable frame, and the backlight controller is configured to provide the backlight unit with a backlight unit signal having a second duty ratio lower than the first duty ratio at a variable blank section of the variable frame.

BRIEF DESCRIPTION OF THE DRAWINGS

These and/or other features of the present disclosure will become apparent from the following description of the embodiments, taken in conjunction with the accompanying drawings in which.

DETAILED DESCRIPTION OF THE EMBODIMENTS

Hereinafter, embodiments according to the present disclosure will be described referring to the accompanying drawings.

Figure 1:
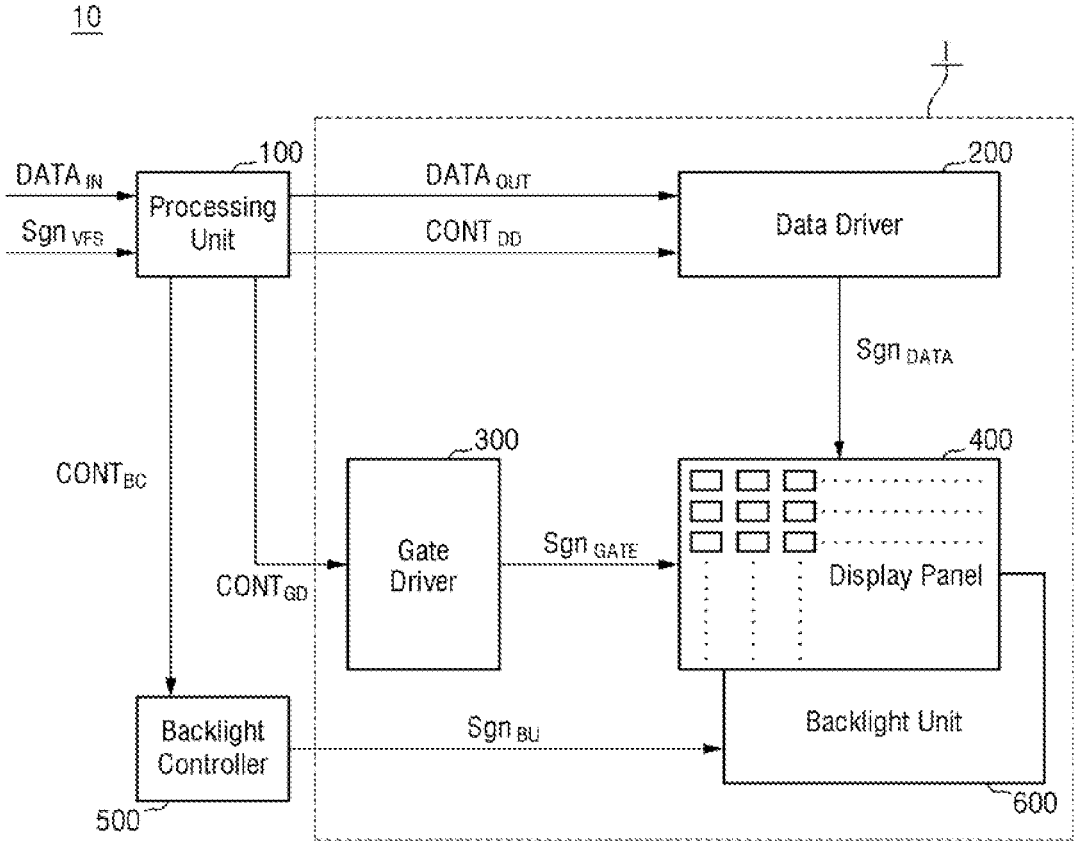
FIG. 1 is a block diagram of a display device according to some embodiments of the present disclosure.

FIG. 1 is a block diagram of a display device according to some embodiments of the present disclosure.

Referring to FIG. 1, a display device 10 may include a processing unit 100, a data driver 200, a gate driver 300, a display panel 400, a backlight controller 500, and a backlight unit 600.

The processing unit 100 may receive an input data DATA_IN and a variable frame synch signal Sgn_VFS from outside (e.g., a Display Driver Integrated Circuit (DDI)). The processing unit 100 may generate an output data DATA_OUT and an internal control signal, using the received input data DATA_IN and the variable frame synch signal Sgn_VFS. The internal control signal may include a data driver control signal CONT_DD, a gate driver control signal CONT_GD, and a backlight controller control signal CONT_BC.

The input data DATA_IN may be RGB data that includes red image data, green image data, and blue image data. The variable frame synch signal Sgn_VFS may determine a start time and an end time of a variable blank section included in the input data DATA_IN.

The processing unit 100 may provide the data driver control signal CONT_DD to the data driver 200 to control the operation of the data driver 200, may provide the gate driver control signal CONT_GD to the gate driver 300 to control the operation of the gate driver 300, and may supply the backlight controller control signal CONT_BC to the backlight controller 500 to control the operation of the backlight controller 500.

The data driver 200 may receive the output data DATA_OUT and the data driver control signal CONT_DD from the processing unit 100. The data driver 200 may generate a data signal Sgn_DATA using the received output data DATA_OUT and the data driver control signal CONT_DD, and may provide the generated data signal Sgn_DATA to the display panel 400. The data driver 200 may provide the data signal Sgn_DATA through a plurality of data lines connected to the display panel 400. The data signal Sgn_DATA may correspond to a plurality of data voltages that are provided to the plurality of data lines.

The gate driver 300 may receive the gate driver control signal CONT_GD from the processing unit 100. The gate driver 300 may generate a gate signal Sgn_GATE using the provided gate driver control signal CONT_GD, and may provide the generated gate signal Sgn_GATE to the display panel 400. The gate driver 300 may provide the gate signal Sgn_GATE through a plurality of gate lines connected to the display panel 400. The gate lines may also be referred to as scan lines.

The display panel 400 may receive the data signal Sgn_DATA from the data driver 200, and may receive the gate signal Sgn_GATE from the gate driver 300. The display panel 400 may include a plurality of pixels connected to the plurality of data lines and the plurality of gate lines. The display panel 400 may display an image by transmitting the light generated by the backlight unit 600. In an embodiment of the present disclosure, the display panel 400 may be, but is not limited to, a liquid crystal display (LCD) panel.

The backlight controller 500 may receive the backlight controller control signal CONT_BC from the processing unit 100. The backlight controller 500 may generate a backlight unit signal Sgn_BU, using the received backlight controller control signal CONT_BC, and may provide the generated backlight unit signal Sgn_BU to the backlight unit 600. The backlight controller 500 may provide the backlight unit signal Sgn_BU through a plurality of backlight unit signal lines connected to the backlight unit 600.

The backlight unit 600 may receive the backlight unit signal Sgn_BU from the backlight controller 500. The backlight unit 600 may include a plurality of light sources connected to the plurality of backlight unit signal lines. The backlight unit 600 may generate light in response to the backlight unit signal Sgn_BU and irradiate the display panel 400 with the generated light. In an embodiment of the present disclosure, the backlight unit 600 may be, but is not limited to, a Light Emitting Diode (LED) backlight.

Figure 2:
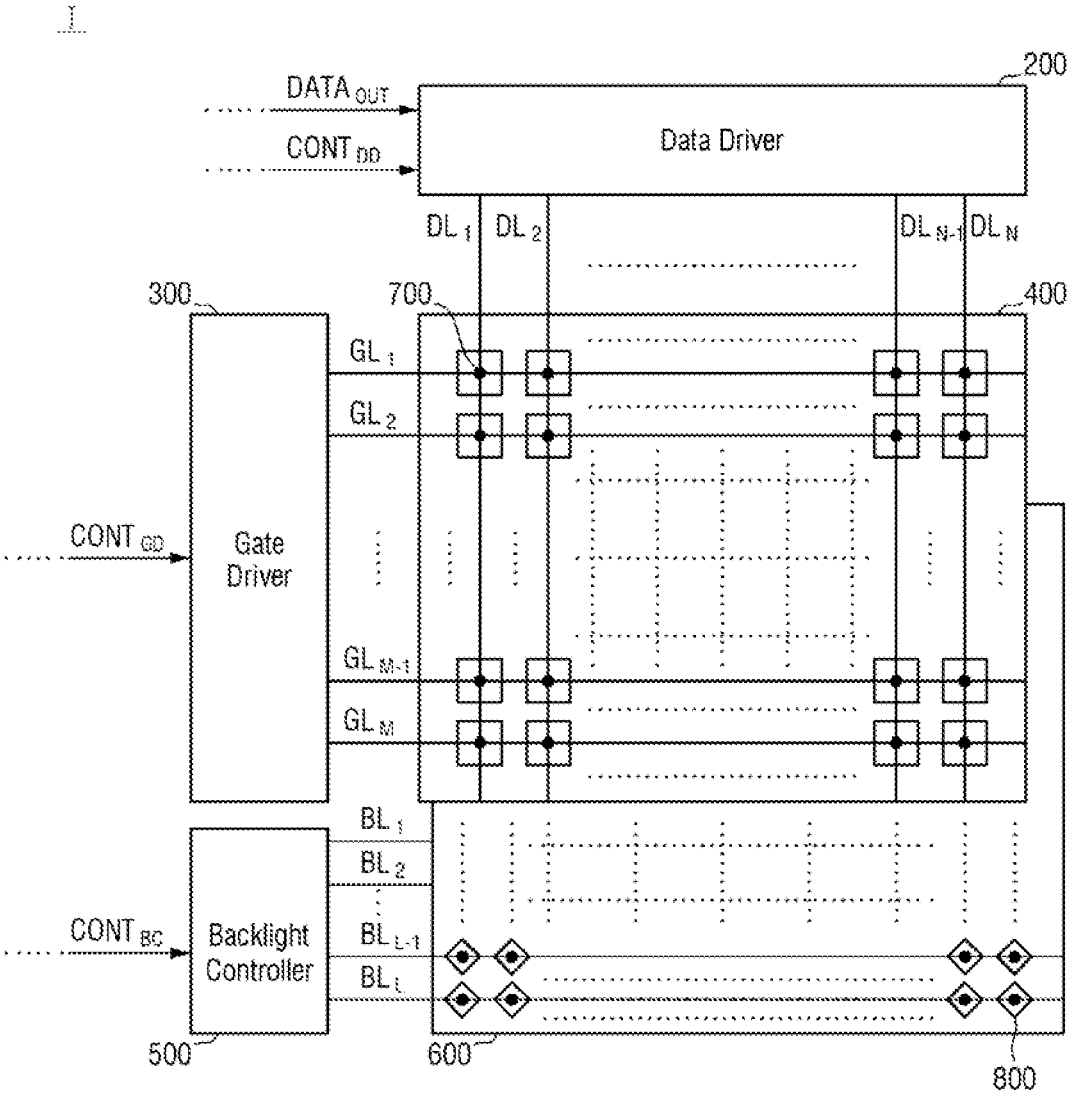
FIG. 2 is an enlarged view of a region I for explaining the operation of the display device of FIG. 1.

FIG. 2 is an enlarged view of a region I for explaining the operation of the display device of FIG. 1.

Referring to FIG. 2, the data driver 200 may provide the data signal to the display panel 400 through the plurality of data lines DL_1 to DL_N. The gate driver 300 may provide the gate signal to the display panel 400 through the plurality of gate lines GL_1 to GL_M. The display panel 400 may include a plurality of pixels 700 connected to the plurality of data lines DL_1 to DL_N and the plurality of gate lines GL_1 to GL_M. Each of the pixels 700 may include a switching transistor, and a liquid crystal capacitor coupled to the switching transistor.

The backlight controller 500 may provide the backlight unit signal to the backlight unit 600 through the plurality of backlight unit signal lines BL_1 to BL_L. The backlight unit 600 may include a plurality of light sources 800 connected to a plurality of backlight unit signal lines. The plurality of light sources 800 may be LEDs, and each light source 800 may operate independently of each other.

Figure 3:
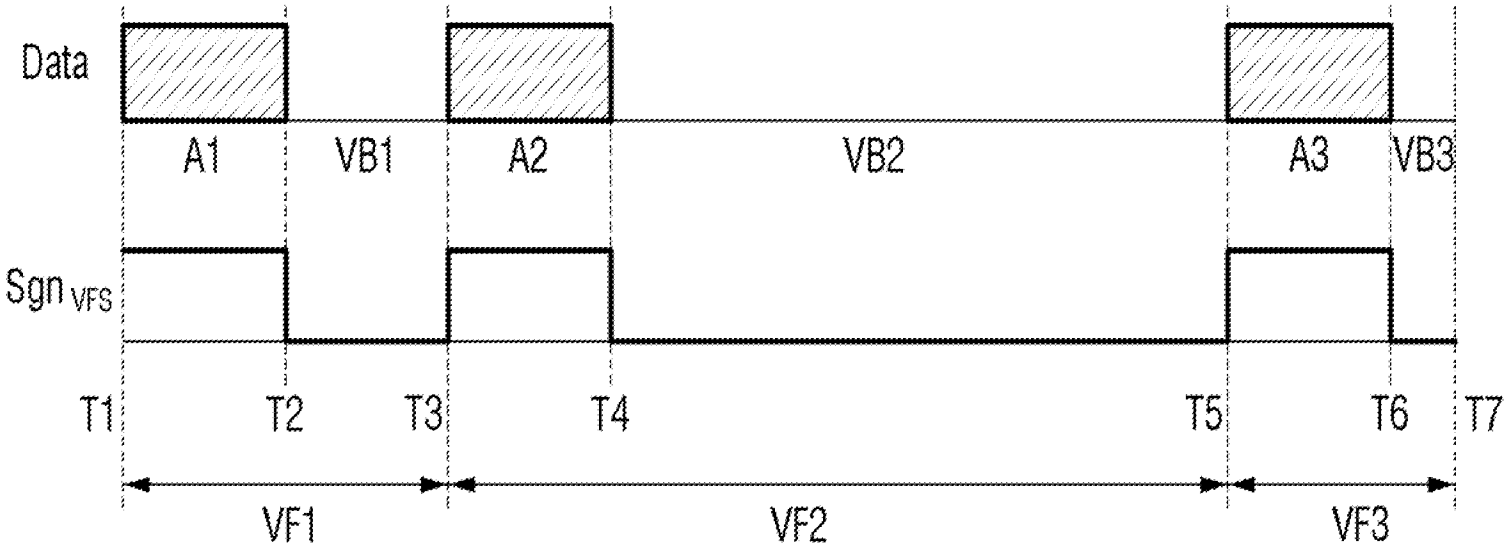
FIG. 3 is a diagram for explaining a relationship between variable frame data and a variable frame synch signal according to an embodiment of the present disclosure.

FIG. 3 is a diagram for explaining a relationship between the variable frame data and the variable frame synch signal according to an embodiment of the present disclosure.

Referring to FIG. 3, the data may be provided to the display device at a variable frame rate. Times from T1 to T3 may correspond to a first variable frame VF1, times from T3 to T5 may correspond to a second variable frame VF2, and times from T5 to T7 may correspond to a third variable frame VF3.

Each of the first to third variable frames VF1 to VF3 may include an active frame in which image data is output, and a variable blank frame in which no image data is output. For example, the first variable frame VF1 may include a first active section A1 and a first variable blank section VB1, the second variable frame VF2 may include a second active section A2 and a second variable blank section VB2, and the third variable frame VF3 may include a third active section A3 and a third variable blank section VB3.

The length of the active section may be the same for all of the first to third variable frames VF1 to VF3. For example, the length of the first active section A1, the length of the second active section A2, and the length of the third active section A3 may be equal to each other. On the other hand, the length of the variable blank section may vary for each of the first to third variable frames VF1 to VF3. For example, as the variable frame rate of data provided from the outside (e.g., from a host) becomes smaller than the frame rate of the display device 10, the length of the variable blank section may increase. For example, the length of the second variable blank section VB2 may be greater than the length of the first variable blank section VB1, The variable frame synch signal Sgn_VFS may determine the start and end times of the variable blank section of the data. The variable frame synch signal Sgn_VFS may be a clock that transitions between two different levels. For example, the variable frame synch signal Sgn_VFS may have a falling edge at the start time of the variable blank section, and may have a rising edge at the end time of the variable blank section. In other words, the variable frame synch signal Sgn_VFS may be a high level at the active section, and may be a low level at the variable blank section. However, the embodiments of the present disclosure are not limited thereto.

Referring to FIGS. 1 to 3, the processing unit 100 may generate an internal operating signal that synchronizes the data driver 200, the gate driver 300, and the backlight controller 500 to execute an operation corresponding to each section at the active section and the variable blank section, using the variable frame synch signal Sgn_VFS.

For example, the processing unit 100 may provide the data driver control signal CONT_DD, the gate driver control signal CONT_GD, and the backlight controller control signal CONT_BC to each of the data driver 200, the gate driver 300, and the backlight controller 500 at the active section from which data is output, and perform a control so that the image is output from the display panel 400.

For example, the data driver control signal CONT_DD and the gate driver control signal CONT_GD may control the data driver 200 and the gate driver 300 to provide the data signal Sgn_DATA and the gate signal Sgn_GATE to the display panel 400 so that the display panel 400 outputs an image at the active section. The backlight controller control signal CONT_BC may control the backlight controller 500 to provide the backlight unit signal Sgn_BU to the backlight unit 600 so that the backlight unit 600 irradiates the strobe light at the active section. At this time, in response to the gate line being sequentially gated by the gate signal Sgn_GATE, the backlight unit signal Sgn_BU may be sequentially provided to the backlight unit 600 through the backlight unit signal line corresponding to the gate line to be gated.

On the other hand, the processing unit 100 may control the data driver 200 and the gate driver 300 not to provide the data signal Sgn_DATA and the gate signal Sgn_GATE to the display panel 400 so that the image is not output from the display panel 400 at the variable blank section. Further, the processing unit 100 may control the backlight controller 500 to provide the backlight unit 600 with a backlight unit signal Sgn_BU different from the active section so that the backlight unit 600 irradiates the flat light. The specific operation will be described later.

Figure 4:
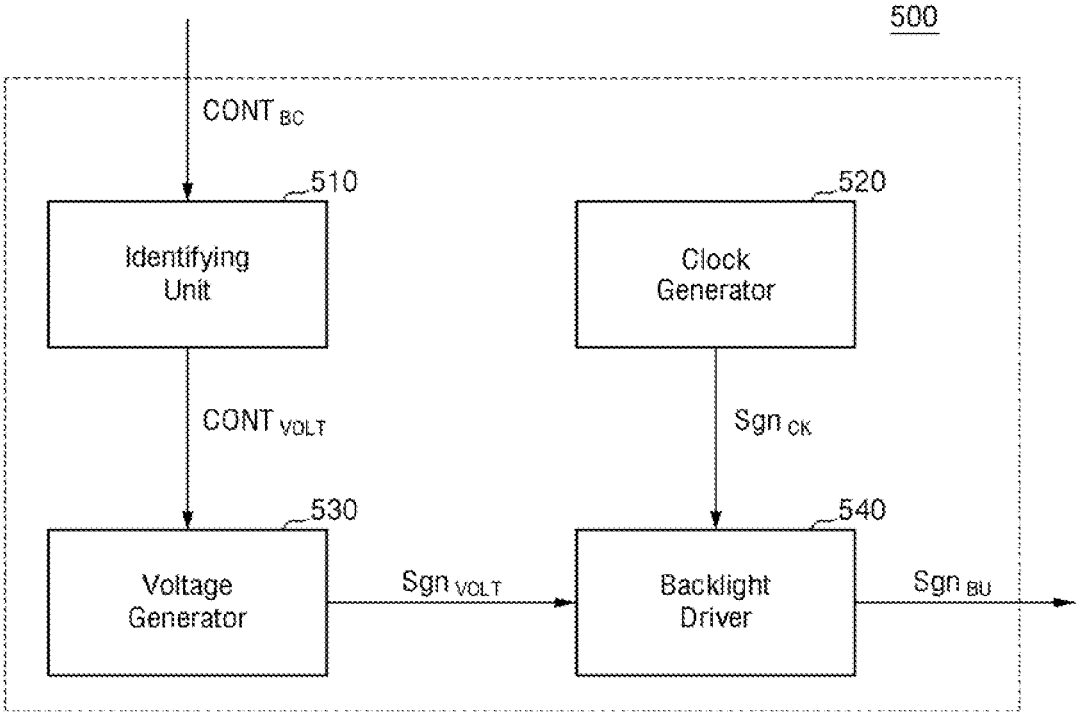
FIG. 4 is a block diagram of a backlight controller of FIG. 1 according to the embodiment of the present disclosure.
Figure 5:
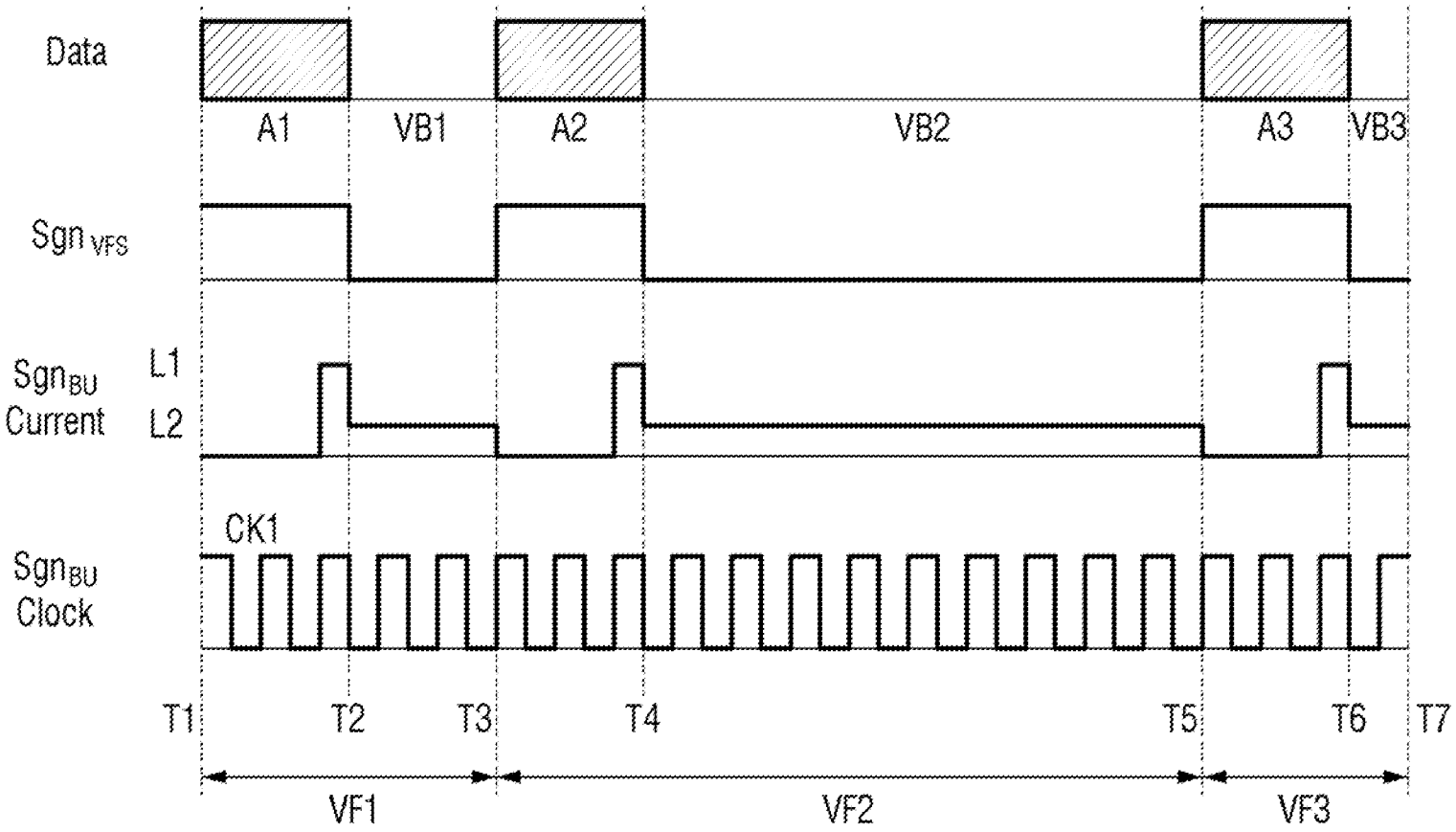
FIG. 5 is a diagram for explaining the operation of the display device according to a backlight unit signal of FIG. 4 according to an embodiment of the present disclosure.

FIG. 4 is a block diagram of the backlight controller of FIG. 1 according to the embodiment of the present disclosure, and FIG. 5 is a diagram for explaining the operation of the display device according to the backlight unit signal of FIG. 4 according to an embodiment of the present disclosure.

First, referring to FIG. 4, the backlight controller 500 may include an identifying unit 510, a clock generator 520, a voltage generator 530, and a backlight driver 540.

The identifying unit 510 may receive the backlight controller control signal CONT_BC from the processing unit 100. The identifying unit 510 may identify the active section and the variable blank section on the basis of the received backlight controller control signal CONT_BC to generate a voltage control signal CONT_VOLT. The identifying unit 510 may provide the generated voltage control signal CONT_VOLT to the voltage generator 530.

The clock generator 520 may generate a clock signal Sgn_CK and provide it to the backlight driver 540.

The voltage generator 530 may receive the voltage control signal CONT_VOLT from the identifying unit 510. The voltage generator 530 may output different levels of a voltage signal Sgn_VOLT at the active section and the variable blank section by the use of the provided voltage control signal CONT_VOLT, and may provide the output voltage signal Sgn_VOLT to the backlight driver 540.

The backlight driver 540 may receive the clock signal Sgn_CK from the clock generator 520 and may receive the voltage signal Sgn_VOLT from the voltage generator 530. The backlight driver 540 may output the backlight unit signal Sgn_BU, using the received clock signal Sgn_CK and the voltage signal Sgn_VOLT, and may provide the backlight unit signal Sgn_BU to the backlight unit 600. The current level of the backlight unit signal Sgn_BU corresponds to the voltage level of the voltage signal Sgn_VOLT, and may have different current levels at a section from the start time of the active section to the irradiation time of the strobe light, a section from the irradiation time of the strobe light to the end time of the active section, and at a variable blank section.

Referring to FIG. 5, the clock (Sgn_BU clock) of the backlight unit signal may have the same duty ratio as CK1 at the active section and the variable blank section. On the other hand, a current (Sgn_BU Current) level of the backlight unit signal may be different at the active section and the variable blank section.

For example, the current (Sgn_BU Current) level of the backlight unit signal at the first active section A1 of the first variable frame VF1, the second active section A2 of the second variable frame VF2, and the third active section A3 of the third variable frame VF3 may have a current level of L1 at the irradiation time of the strobe light.

On the other hand, the current (Sgn_BU Current) level of the backlight unit signal at the first variable blank section VB1 of the first variable frame VF1, the second variable blank section VB2 of the second variable frame VF2, and the third variable blank section VB3 of the third variable frame VF3 may have a current level of L2. Here, the value of the current level L1 may be greater than the value of the current level L2.

Figure 6:
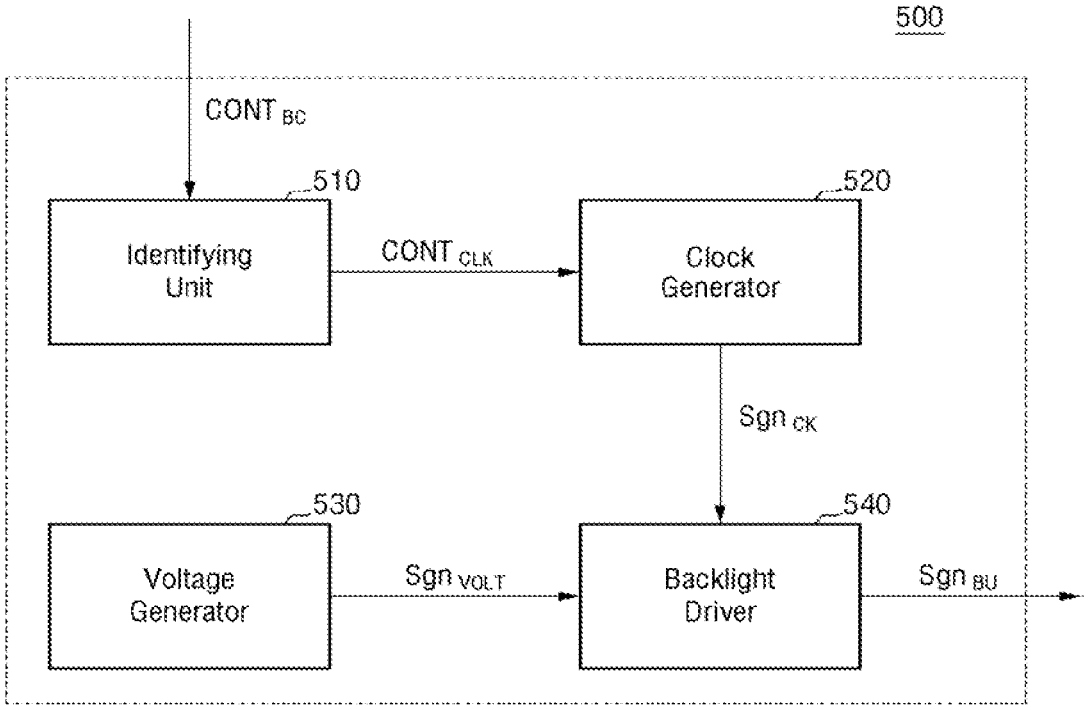
FIG. 6 is a block diagram of the backlight controller of FIG. 1 according to another embodiment of the present disclosure.
Figure 7:
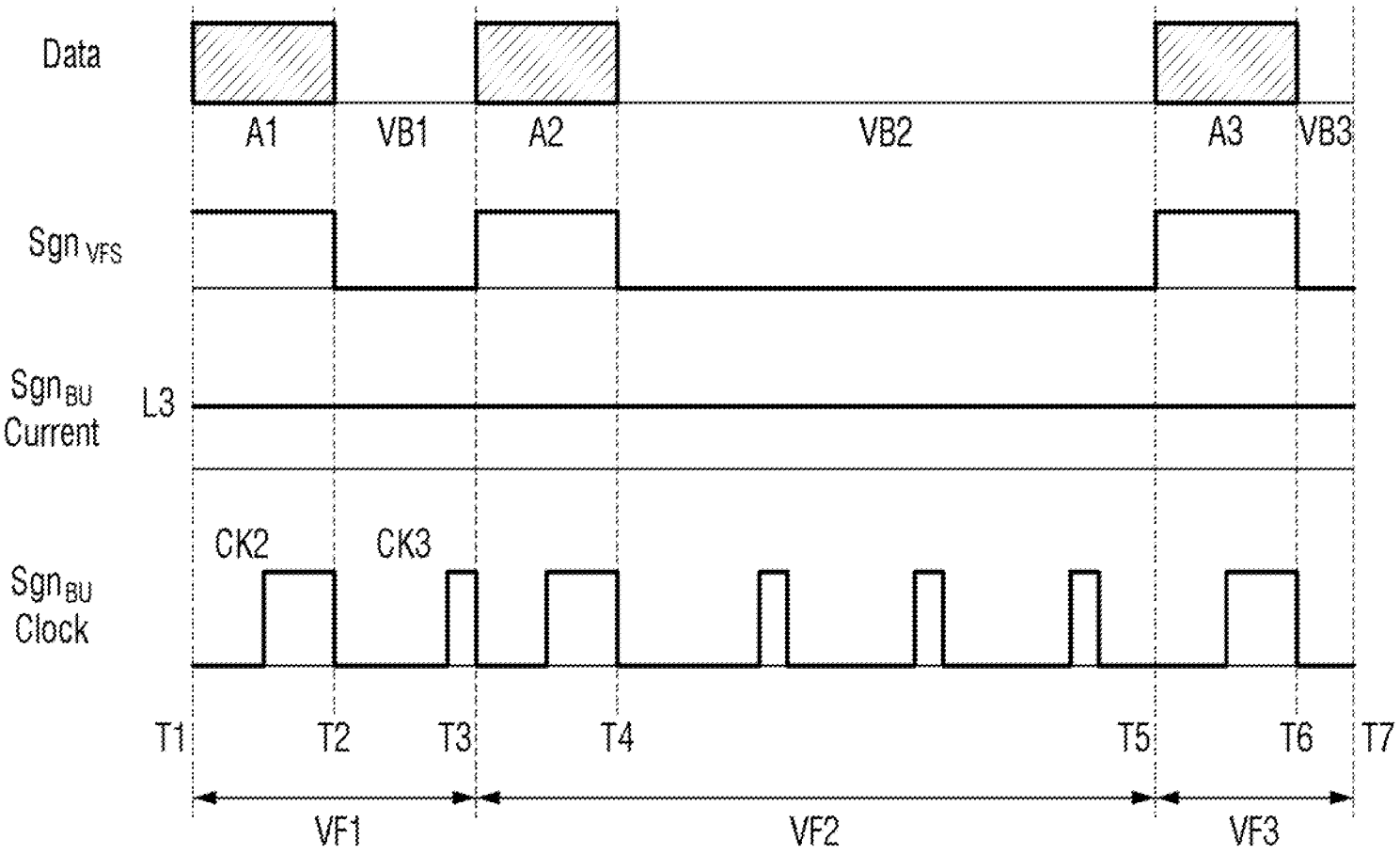
FIG. 7 is a diagram for explaining the operation of the display device according to a backlight unit signal of FIG. 6 according to another embodiment of the present disclosure.

FIG. 6 is a block diagram of the backlight controller of FIG. 1 according to another embodiment of the present disclosure, and FIG. 7 is a diagram for explaining the operation of the display device according to the backlight unit signal of FIG. 6 according to another embodiment of the present disclosure.

First, referring to FIG. 6, the identifying unit 510 may identify the active section and the variable blank section using the received backlight controller control signal CONT_BC to generate the clock control signal CONT_CLK. The identifying unit 510 may provide the generated clock control signal CONT_CLK to the clock generator 520.

The clock generator 520 may receive the clock control signal CONT_CLK from the identifying unit 510. The clock generator 520 may output the clock signal Sgn_CK having different duty ratios at the active section and the variable blank section, using the received clock control signal CONT_CLK, and may provide the output clock signal Sgn_CK to the backlight driver 540.

The voltage generator 530 may generate a voltage signal Sgn_VOLT and provide it to the backlight driver 540.

The backlight driver 540 may receive the clock signal Sgn_CK from the clock generator 520 and receive the voltage signal Sgn_VOLT from the voltage generator 530. The backlight driver 540 may output the backlight unit signal Sgn_BU, using the received clock signal Sgn_CK and the voltage signal Sgn_VOLT, and may provide the backlight unit signal Sgn_BU to the backlight unit 600. A duty ratio of the backlight unit signal Sgn_BU corresponds to a duty ratio of the clock signal Sgn_CK, and the backlight unit signal Sgn_BU may have different duty ratios at the active section and the variable blank section.

Referring to FIG. 7, the current (Sgn_BU Current) level of the backlight unit signal may be the same level of L3 at the active section and the variable blank section. On the other hand, the clock (Sgn_BU clock) of the backlight unit signal may have a different duty ratio at the active section and the variable blank section.

For example, the clock (Sgn_BU clock) of the backlight unit signal may be the clock of CK2 at the first active section A1 of the first variable frame VF1, the second active section A2 of the second variable frame VF2, and the third active section A3 of the third variable frame VF3.

On the other hand, the clock (Sgn_BU clock) of the backlight unit signal may be the clock of CK3 at the first variable blank section VB1 of the first variable frame VF1, the second variable blank section VB2 of the second variable frame VF2, and the third variable blank section VB3 of the third variable frame VF3. Here, the duty ratio of the clock CK2 may be greater than the duty ratio of the clock CK3.

This way, since the backlight controller 500 provides the backlight unit 600 with the backlight unit signals having different current levels or having different duty ratios at the active section and the variable blank section, the backlight unit 600 may provide the display panel 400 with light having different brightness at the active section and the variable blank section. For example, the backlight unit 600 may irradiate the strobe light at the active section and irradiate the flat light at the variable blank section.

Figure 8:
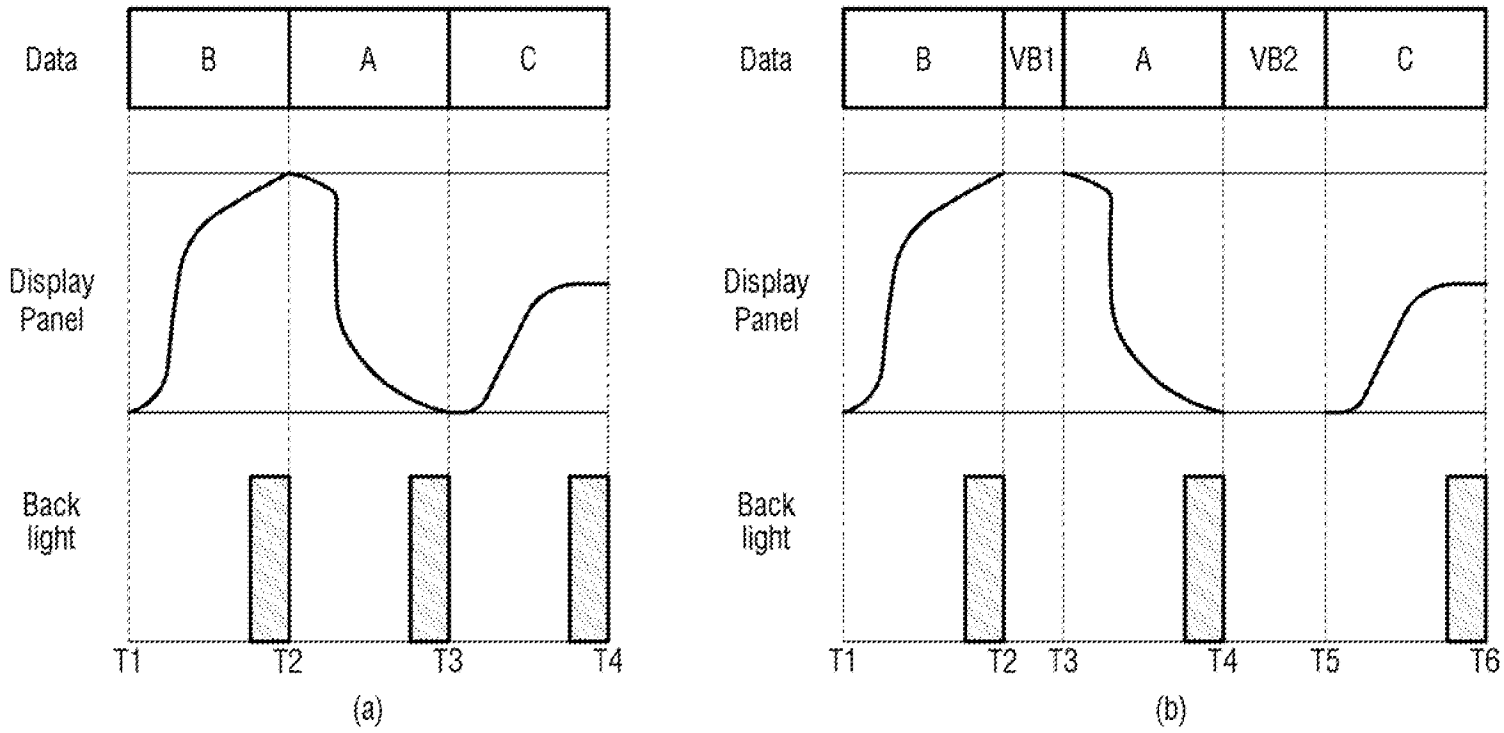
FIG. 8 is a diagram for explaining a data output figure of the display panel according to the strobe light at the fixed frame rate and the variable frame rate.
Figure 9:
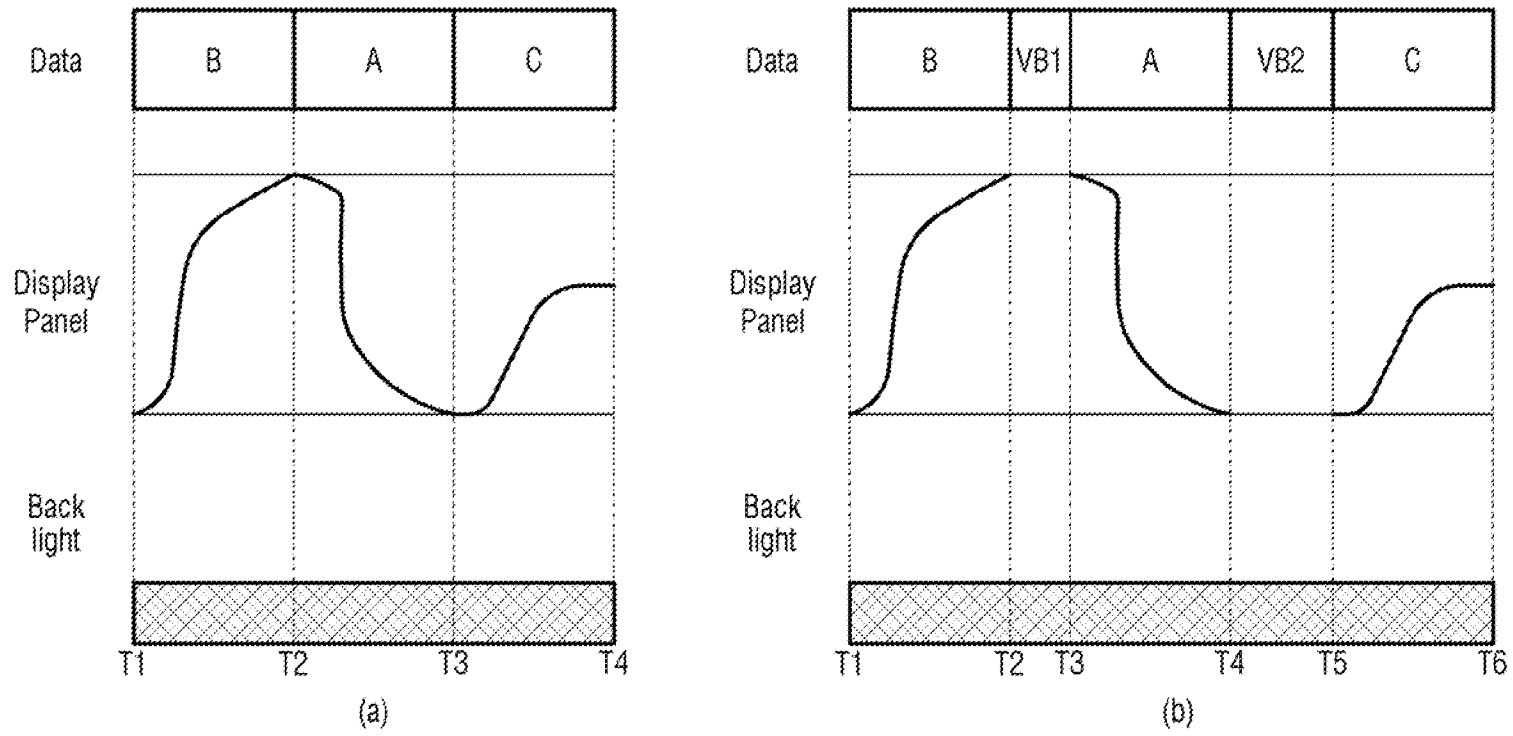
FIG. 9 is a diagram for explaining the data output figure of the display panel according to the flat light at the fixed frame rate and the variable frame rate.
Figure 10:
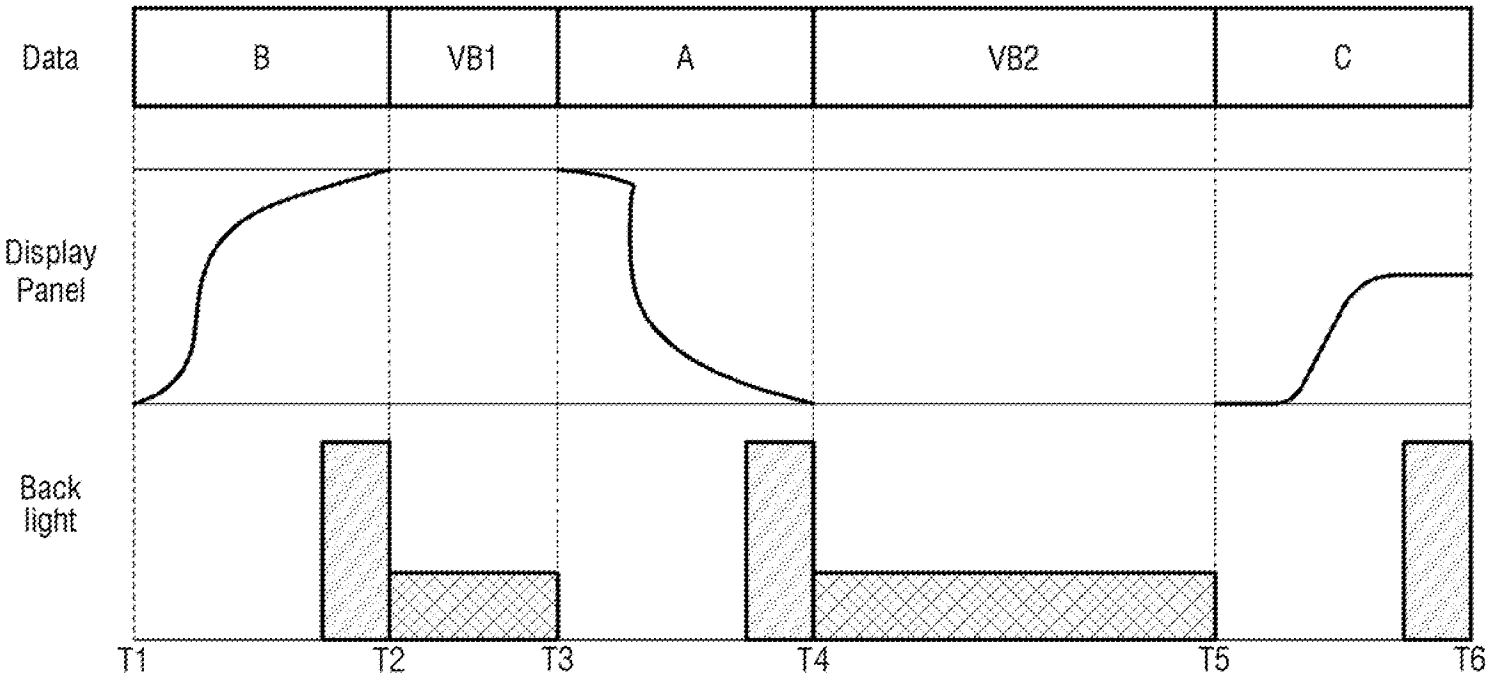
FIG. 10 is a diagram for explaining a data output figure of the display panel according to the operation of the backlight unit according to an embodiment of the present disclosure.

FIG. 8 is a diagram for explaining a data output figure of the display panel according to the strobe light at the fixed frame rate and the variable frame rate, FIG. 9 is a diagram for explaining the data output figure of the display panel according to the flat light at the fixed frame rate and the variable frame rate, and FIG. 10 is a diagram for explaining a data output figure of the display panel according to the operation of the backlight unit according to an embodiment of the present disclosure.

FIG. 8(*a*) is a data output figure of the display panel according to the strobe light at the fixed frame rate, and FIG. 8(*b*) is a data output figure of the display panel according to the strobe light at the variable frame rate.

At the fixed frame rate of FIG. 8(*a*), the backlight unit may irradiate the display panel with strobe light at a certain time for each frame due to the absence of the variable blank section. Accordingly, the display panel may instantaneously output the corresponding data at a certain time of each frame to obtain a clear image.

For example, when data B corresponding to the time between T1 and T2 is output, the internal structure of the display panel may be transitioned to output data B from the data of the frame before T1. In this process, since the strobe light is irradiated immediately before the end time of the frame to which the data B corresponds, in other words, immediately before T2, the process of transition of the display panel is not output to the outside, and only the data B is output to obtain a clear image.

On the other hand, at the variable frame rate of FIG. 8(*b*), due to the existence of the variable blank section, the backlight unit may not have a constant time interval for irradiating the display panel with strobe light for each frame. Accordingly, a flicker may occur in the image that is output through the display panel.

For example, the length of VB1, which is a variable blank section corresponding to the time between T2 and T3, may be different from that of VB2 which is a variable blank section corresponding to the time between T4 and T5. Accordingly, since a difference between timing of the strobe light irradiated to output the data B corresponding to the time between T1 and T2 and timing of the strobe light irradiated to output the data A corresponding to the time between T3 and T4 is not equal to a difference between timing of the strobe light irradiated to output the data A corresponding to the time between T3 and T4 and timing of the strobe light irradiated to output the data B corresponding to the time between T5 and T6, flicker may occur.

FIG. 9(*a*) is a data output figure of the display panel according to the flat light at a fixed frame rate, and FIG. 9(*b*) is a data output figure of the display panel according to the flat light at a variable frame rate.

At the fixed frame rate of FIG. 9(*a*), the backlight unit may irradiate the display panel with flat light having a constant brightness value in all frames. However, this may cause the data corresponding to each frame to be output in a blurred manner.

For example, when the data B corresponding to the time between T1 and T2 is output, the internal structure of the display panel may be transitioned to output the data B from the data of the frame before T1. In this process, since the backlight unit irradiates the entire frame to which the data B corresponds with flat light, all the processes of transitioning of the display panel are output through the display panel, and a blurred image may be output.

On the other hand, at the variable frame rate of FIG. 9(*b*), the backlight unit may prevent an occurrence of flicker by irradiating light having a constant brightness value at both the active section and the variable blank section.

For example, the length of VB1 which is a variable blank section corresponding to the time between T2 and T3 may be different from that of VB2 which is a variable blank section corresponding to the time between T4 and T5. As the backlight unit irradiates light of the same brightness as the active section which also outputs data at the variable blank section, it is possible to prevent flicker that may occur when the total amount of light irradiated by the backlight unit suddenly changes for a certain period of time.

In FIG. 10, the backlight unit 600 according to an embodiment of the present disclosure may irradiate the display panel 400 with strobe light at the active section where data is output, and irradiate flat light at the variable blank section in which the data is not output. As a result, the display panel 400 may output a clear image by the strobe light at the active section in which the data is output, and may prevent an occurrence of flicker by the flat light at the variable blank section in which data is not output.

Figure 11:
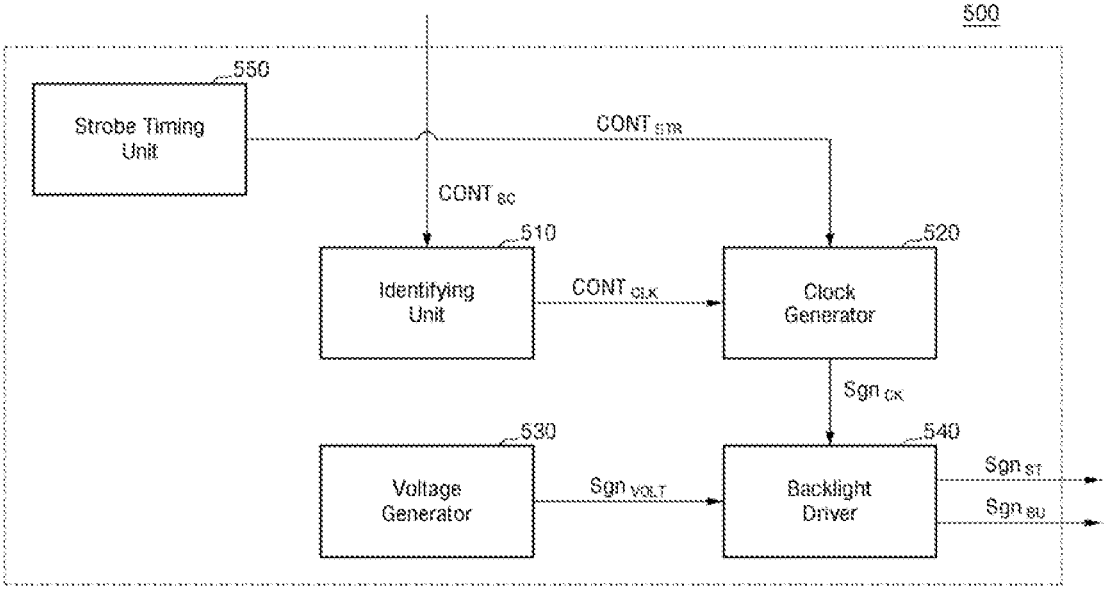
FIG. 11 is a block diagram of the backlight controller of FIG. 1 for adjusting the brightness of the backlight unit according to an embodiment of the present disclosure.
Figure 12:
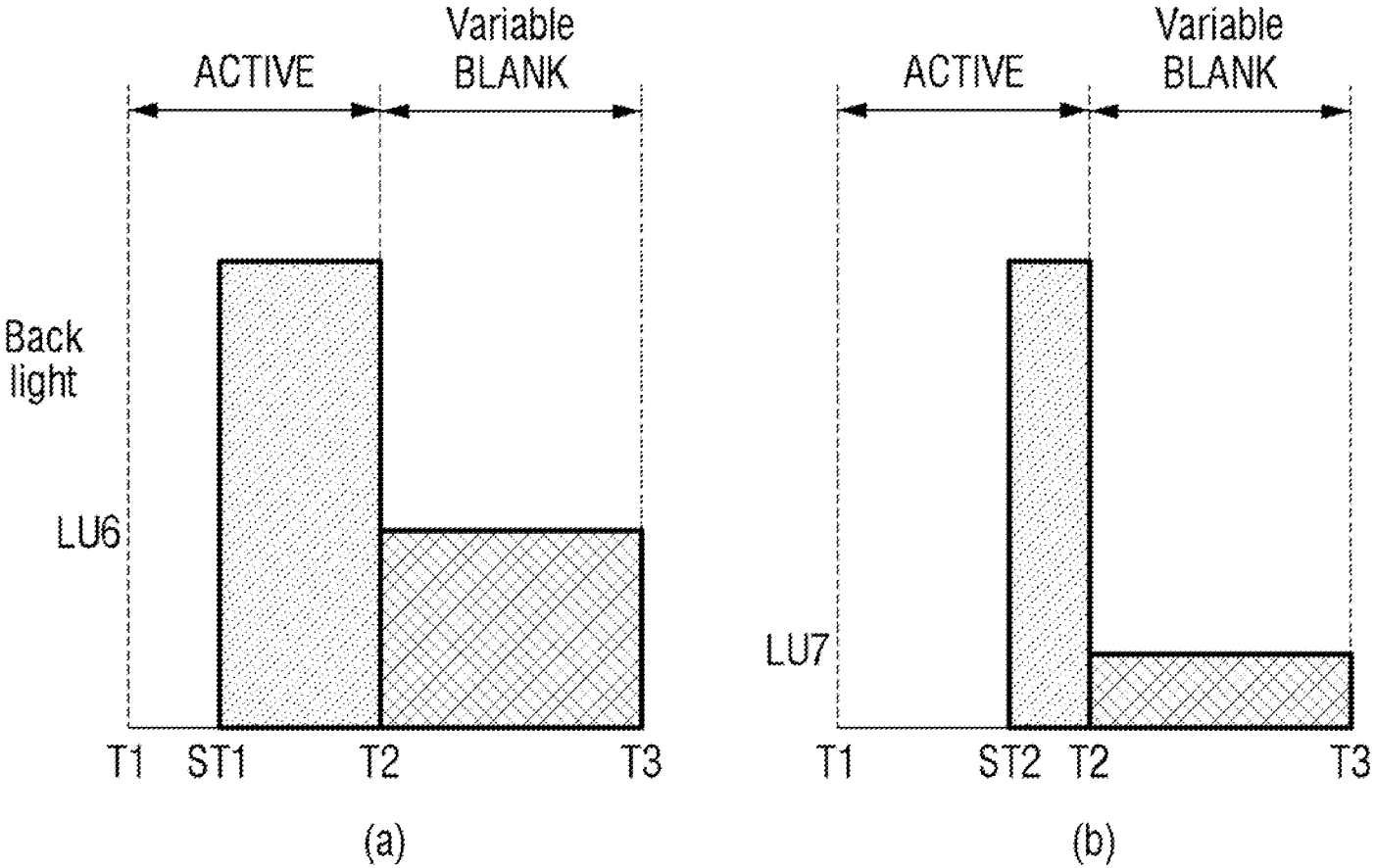
FIG. 12 is a diagram for explaining a method for adjusting the brightness of the backlight unit according to an embodiment of the present disclosure.

FIG. 11 is a block diagram relating to the backlight controller of FIG. 1 for adjusting the brightness of the backlight unit according to an embodiment of the present disclosure, and FIG. 12 is a diagram for explaining a method for adjusting the brightness of the backlight unit according to the embodiment of the present disclosure.

The backlight controller 500 may further include a strobe timing unit 550. The strobe timing unit 550 may output a strobe timing control signal CONT_STR and provide it to the clock generator 520.

The clock generator 520 may provide the clock signal Sgn_CK to the backlight driver 540, using the strobe timing control signal CONT_STR provided from the strobe timing unit 550 and the clock control signal CONT_CLK provided from the identifying unit 510.

The backlight driver 540 may provide the backlight unit 600 with a strobe timing signal Sgn_ST together with the backlight unit signal Sgn_BU. The backlight unit 600 may further adjust the brightness of the display panel 400, using the additionally provided strobe timing signal Sgn_ST.

In FIG. 12(*a*), the backlight unit 600 may irradiate the strobe light from the time ST1 at the active section by the additionally provided strobe timing signal Sgn_ST. On the other hand, in FIG. 12(*b*), the backlight unit 600 may irradiate the strobe light from the time ST2 at the active section by the additionally provided strobe timing signal Sgn_ST. The time ST1 may occur earlier in the time period from T1 to T2 than the time ST2.

The brightness value of the strobe light irradiated at the active section of (a) may be the same as the brightness value of the strobe light irradiated at the active section of (b). However, the irradiation time ST1 of the strobe light irradiated at the active section of (a) may be faster than the irradiation time ST2 of the strobe light irradiated at the active section of (b), and the irradiation time of the strobe light may be long. As a result, the amount of light irradiated to the display panel 400 may increase, and the brightness of the display panel 400 may be adjusted.

On the other hand, a brightness value LU6 of the flat light of the variable blank section of (a) may be greater than a brightness value LU7 of the flat light of the variable blank section of (b), due to the difference in irradiation timing of the strobe light. A description thereof will be provided later.

Figure 13:
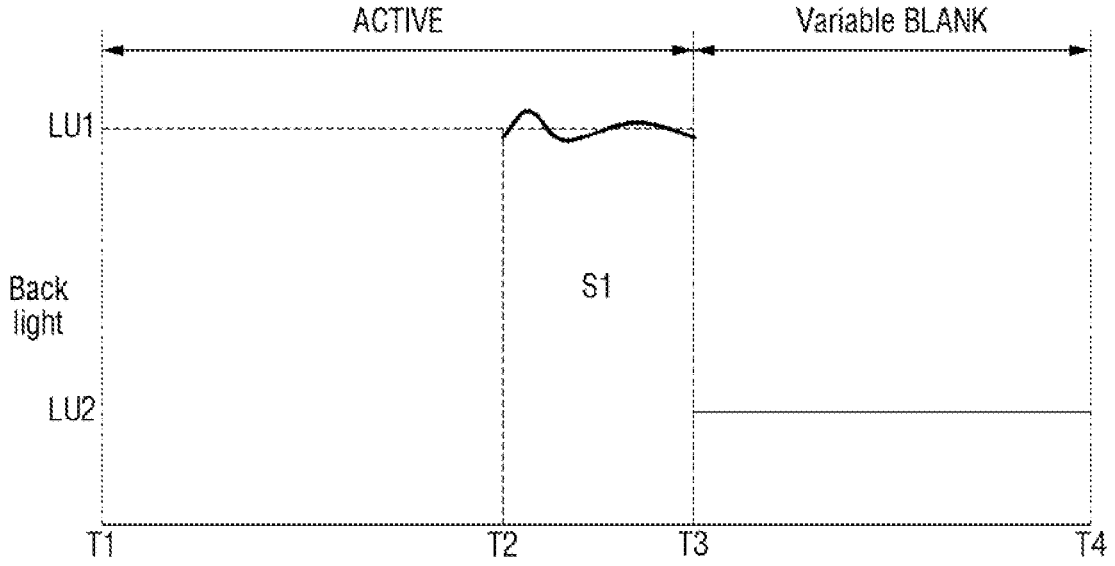
FIG. 13 is a diagram for explaining the brightness value of the flat light at the variable blank section according to an embodiment of the present disclosure.

FIG. 13 is a diagram for explaining the brightness value of the flat light at the variable blank section according to an embodiment of the present disclosure.

Referring to FIG. 13, the backlight unit 600 may irradiate the time display panel 400 with the strobe light having a brightness value of LU1 at the active section during the time from T2 to T3.

On the other hand, a flicker may occur when the amount of light irradiated through the display panel 400 for a certain period of time is not constant. In general, the human eye may perceive a difference in brightness when there is a sharp difference in the total amount of light incident for 1/60 seconds, and a flicker may occur accordingly. Assuming that the frame rate of the display device is generally 60 Hz, LU2, which is the brightness value of the flat light irradiated at the variable blank section to prevent such flicker, may be determined by the following Formula.

$$LU2 = \frac{S1}{T3 - T1} \quad \text{[Formula 1]}$$

Here, T1 is a start time of the active section, T2 is an irradiation start time of the strobe light at the active section, T3 is an end time of the active section, and S1 may be a total amount by which the display panel 400 is irradiated with the strobe light having the brightness value of LU1 from T2 to T3. In other words, the brightness value of the flat light at the variable blank section may have the same value as the average brightness value of the entire active section.

On the other hand, the brightness value of the strobe light may not be constant as shown. Therefore, LU2, which is the brightness value of flat light, may be expressed as follows.

$$LU2 = \frac{\int_{T2}^{T3} L_1(t)dt}{T3 - T1} \quad \text{[Formula 2]}$$

Here, $L_1(t)$ may be a brightness value function to the time of the strobe light.

Figure 14:
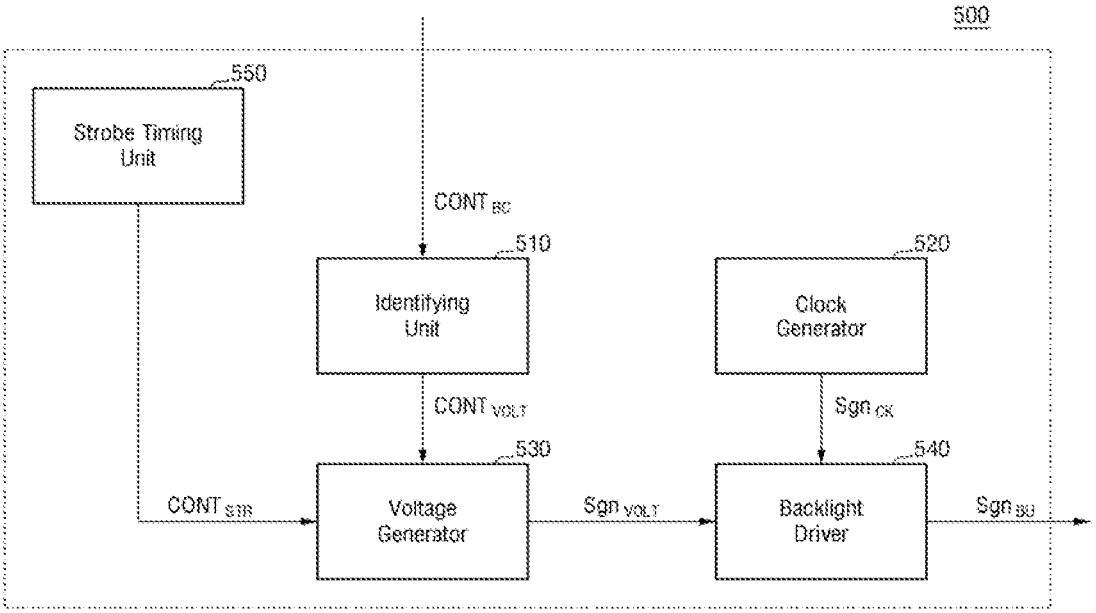
FIG. 14 is a block diagram of the backlight controller of FIG. 1 according to another embodiment of the present disclosure.
Figure 15:
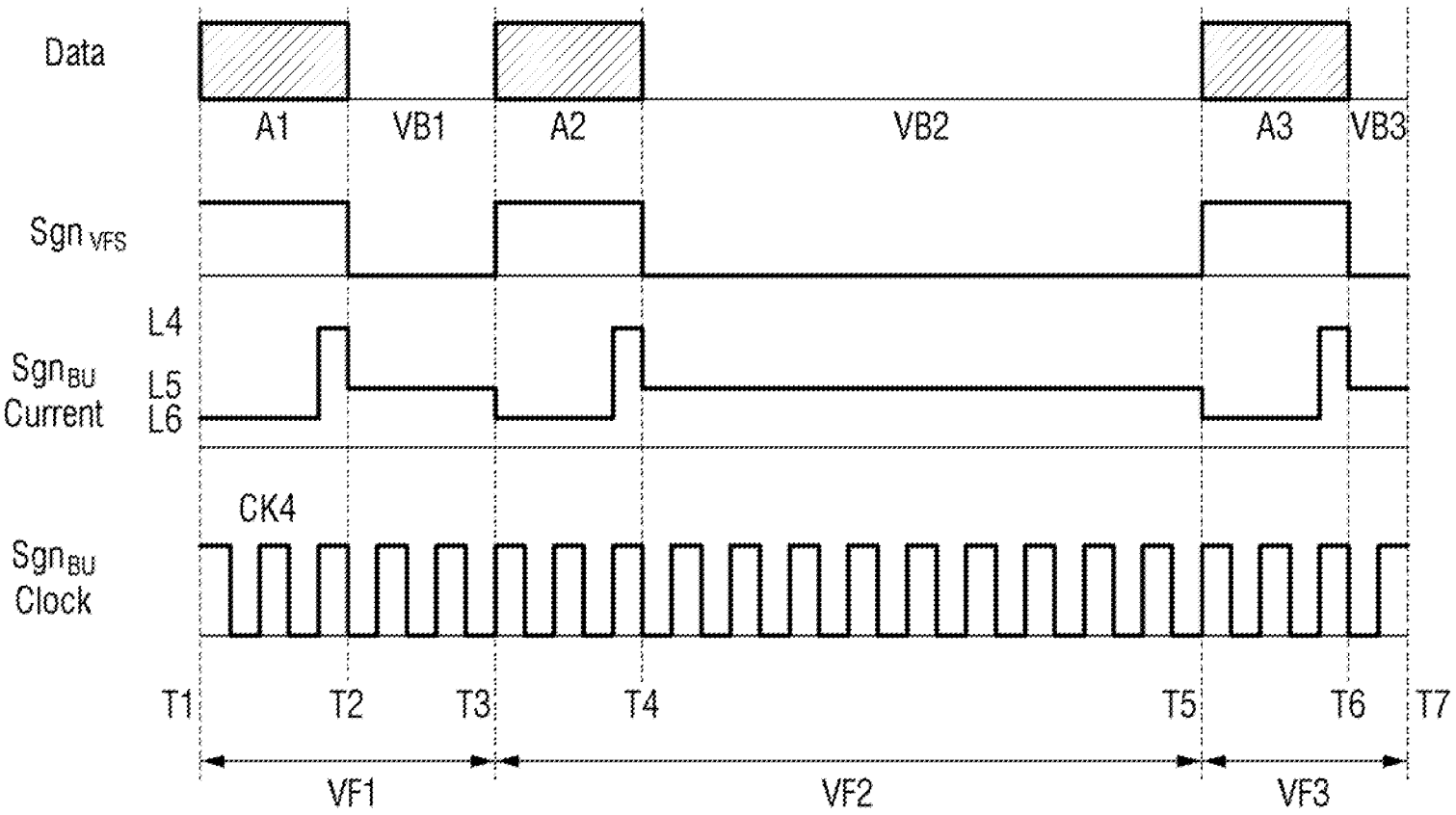
FIG. 15 is a diagram for explaining the operation of the display device according to the backlight unit signal of FIG. 14 according to still another embodiment of the present disclosure.

FIG. 14 is a block diagram of the backlight controller of FIG. 1 according to another embodiment of the present disclosure, and FIG. 15 is a diagram for explaining the operation of the display device according to the backlight unit signal of FIG. 14 according to still another embodiment of the present disclosure.

First, referring to FIG. 14, the strobe timing unit 550 may output the strobe timing control signal CONT_STR and supply it to the voltage generator 530.

The clock generator 520 may generate a clock signal Sgn_CK and provide it to the backlight driver 540.

The voltage generator 530 may output different levels of voltage signals Sgn_VOLT at a section from the start time of the active section to the irradiation time of the strobe light, at a section from the irradiation time of the strobe light to the end time of the active section, and at the variable blank section, by the use of the strobe timing control signal CONT_STR provided from the strobe timing unit 550 and the voltage control signal CONT_VOLT provided from the identifying unit 510, and may provide the output voltage signal Sgn_VOLT to the backlight driver 540.

The backlight driver 540 may receive the clock signal Sgn_CK from the clock generator 520 and receive the voltage signal Sgn_VOLT from the voltage generator 530. The backlight driver 540 may output the backlight unit signal Sgn_BU by the use of the provided clock signal Sgn_CK and the voltage signal Sgn_VOLT, and may provide the backlight unit signal Sgn_BU to the backlight unit 600. The current level of the backlight unit signal Sgn_BU corresponds to the voltage level of the voltage signal Sgn_VOLT, and may have different levels at the active section and the variable blank section.

Referring to FIG. 15, the clock (Sgn_BU clock) of the backlight unit signal may have the same duty ratio as CK4 at the active section and the variable blank section. On the other hand, the current (Sgn_BU Current) level of the backlight unit signal may be different at the active section and the variable blank section. Further, at the active section, the current level may be different. For example, the active section may be divided into two sections on the basis of irradiation time of the strobe light.

For example, at the first active section A1 of the first variable frame VF1, the second active section A2 of the second variable frame VF2, and the third active section A3 of the third variable frame VF3, the current (Sgn_BU Current) level of the backlight unit signal from the start time of the active section to the irradiation time of the strobe light may have a value of L6.

Next, at the first active section A1 of the first variable frame VF1, the second active section A2 of the second variable frame VF2, and the third active section A3 of the third variable frame VF3, the current (Sgn_BU Current) level of the backlight unit signal from the irradiation time of strobe light to the end time of the active section may have a value of L4.

On the other hand, the current (Sgn_BU Current) level of the backlight unit signal may have a current level of L5 at the first variable blank section VB1 of the first variable frame VF1, the second variable blank section VB2 of the second variable frame VF2, and the third variable blank section VB3 of the third variable frame VF3. Here, the value of the current level L5 may be greater than the value of the current level L6, or may be smaller than the value of the current level L4.

Figure 16:
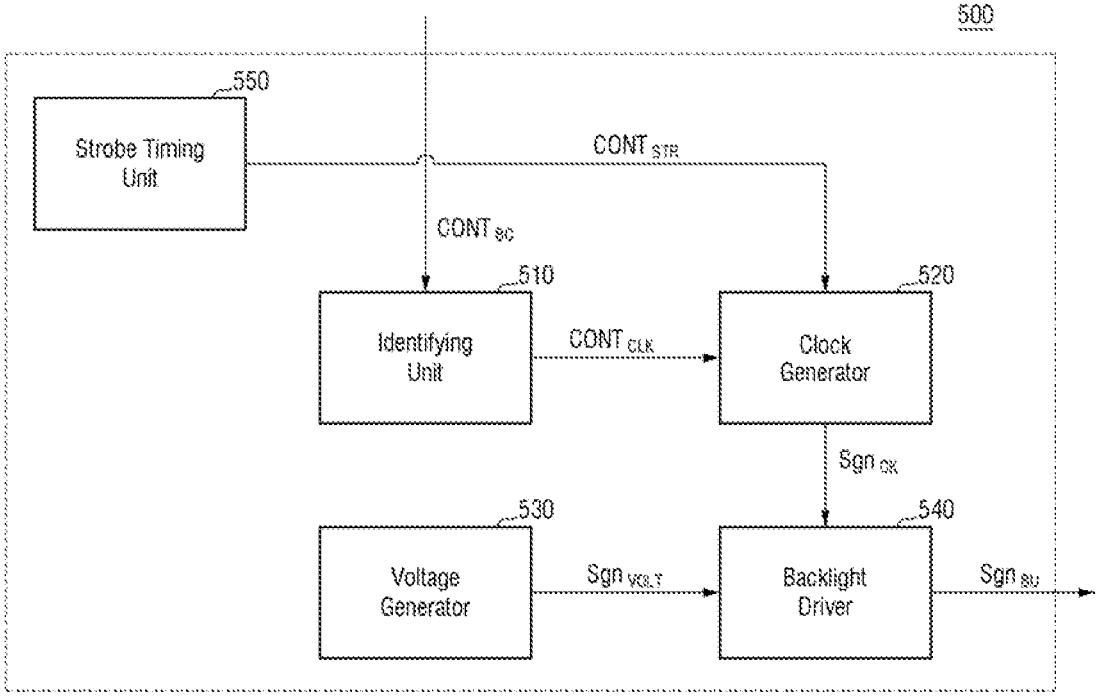
FIG. 16 is a block diagram of the backlight controller of FIG. 1 according to another embodiment of the present disclosure.
Figure 17:
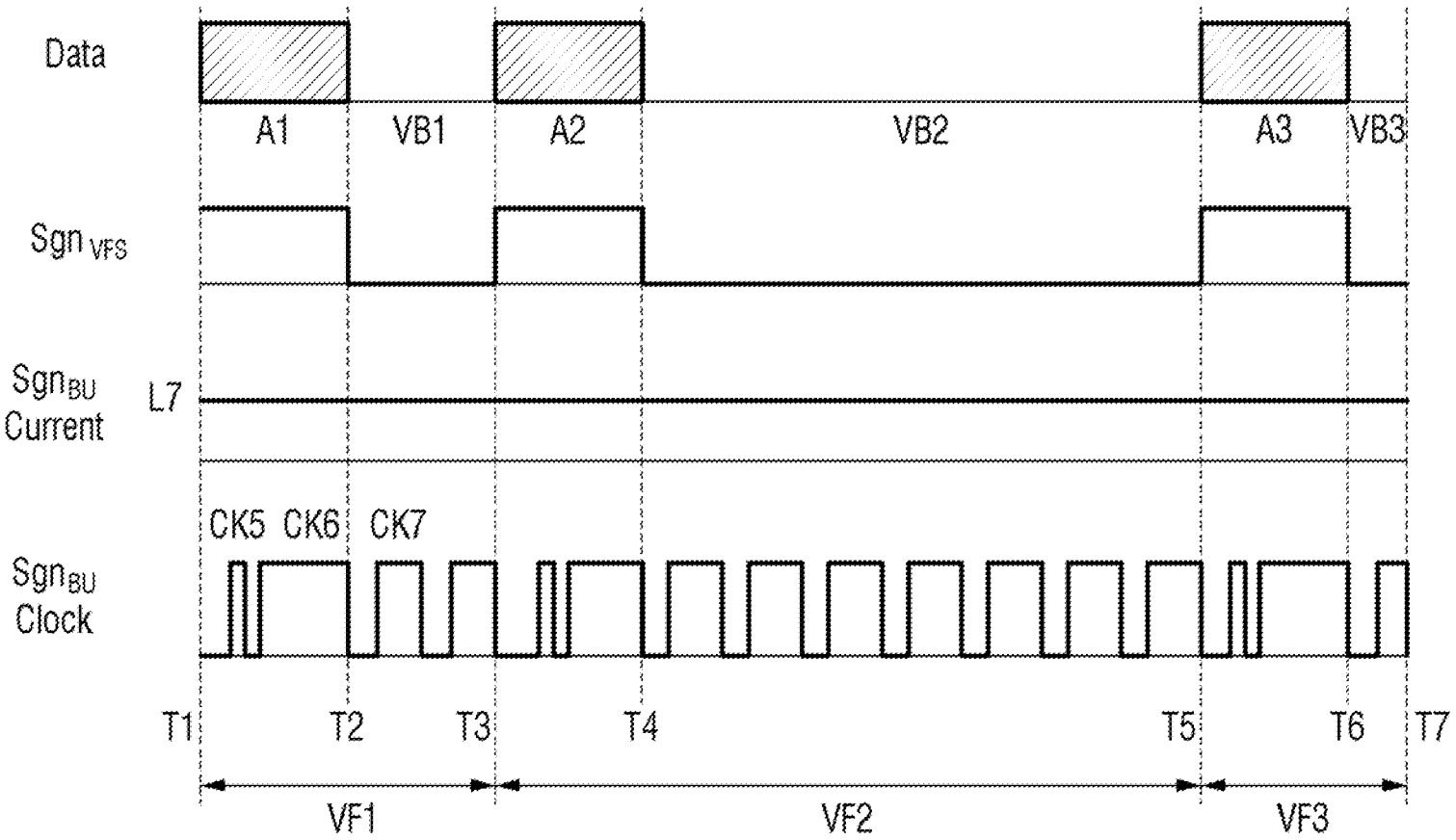
FIG. 17 is a diagram for explaining the operation of the display device according to the backlight unit signal of FIG. 16 according to another embodiment of the present disclosure.

FIG. 16 is a block diagram of the backlight controller of FIG. 1 according to another embodiment of the present disclosure, and FIG. 17 is a diagram for explaining the operation of the display device according to the backlight unit signal of FIG. 16 according to another embodiment of the present disclosure.

First, referring to FIG. 16, the strobe timing unit 550 may output the strobe timing control signal CONT_STR and provide it to the clock generator 520.

The clock generator 520 may output a clock signal Sgn_CK having different duty ratios from each other, using the strobe timing control signal CONT_STR provided from the strobe timing unit 550 and the clock control signal CONT_CLK provided from the identifying unit 510, at a section from the start time of the active section to the irradiation time of the strobe light, a section from the irradiation time of strobe light to the end time of the active section, and the variable blank section, and may provide the output clock signal Sgn_CK to the backlight driver 540.

The voltage generator 530 may generate a voltage signal Sgn_VOLT and provide it to the backlight driver 540.

The backlight driver 540 may receive the clock signal Sgn_CK from the clock generator 520, and may receive the voltage signal Sgn_VOLT from the voltage generator 530. The backlight driver 540 may output the backlight unit signal Sgn_BU, using the received clock signal Sgn_CK and the voltage signal Sgn_VOLT, and may provide the backlight unit signal Sgn_BU to the backlight unit 600. The duty ratio of the backlight unit signal Sgn_BU corresponds to the duty ratio of the clock signal Sgn_CK, and may have different duty ratios at the active section and the variable blank section.

Referring to FIG. 17, the current (Sgn_BU Current) level of the backlight unit signal may be the same level of L7 at the active section and the variable blank section. On the other hand, the duty ratios of the clock (Sgn_BU clock) of the backlight unit signal may be different at the active section and the variable blank section. Further, the duty ratios may be different from each other within the active section by dividing the active section into two sections on the basis of the irradiation time of the strobe light.

For example, at the first active section A1 of the first variable frame VF1, the second active section A2 of the second variable frame VF2, and the third active section A3 of the third variable frame VF3, the clock (Sgn_BU clock) of the backlight unit signal from the start time of the active section to the irradiation time of the strobe light may be the clock of CK5.

Next, from the first active section A1 of the first variable frame VF1, the second active section A2 of the second variable frame VF2, and the third active section A3 of the third variable frame VF3, the clock (Sgn_BU clock) of the backlight unit signal from the irradiation time of the strobe light to the end time of the active section may be clock of CK6.

On the other hand, the clock (Sgn_BU clock) of the backlight unit signal may be clock of CK7 at the first variable blank section VB1 of the first variable frame VF1, the second variable blank section VB2 of the second variable frame VF2, and the third variable blank section VB3 of the third variable frame VF3. Here, the duty ratio of the clock CK7 may be greater than the duty ratio of the clock CK5 or smaller than the duty ratio of the clock CK6.

This way, since the backlight controller 500 provides the backlight unit 600 with the backlight unit signal having different current levels or different duty ratios at the active section including the two sections divided on the basis of the irradiation time of the strobe light and the variable blank section, the backlight unit 600 may provide light having different brightness to the display panel 400 at the section from the start time of the active section to the irradiation time of the strobe light, the section from the irradiation time of the strobe light to the end time of the active section, and the variable blank section.

For example, the backlight unit 600 may irradiate the first flat light at the section from the start time of the active section to the irradiation time of the strobe light, may irradiate the strobe light at the section from the irradiation time of the strobe light to the end time of the active section, and may irradiate the second flat light at the variable blank section. The brightness value of the second flat light may be greater than the brightness value of the first flat light.

Figure 18:
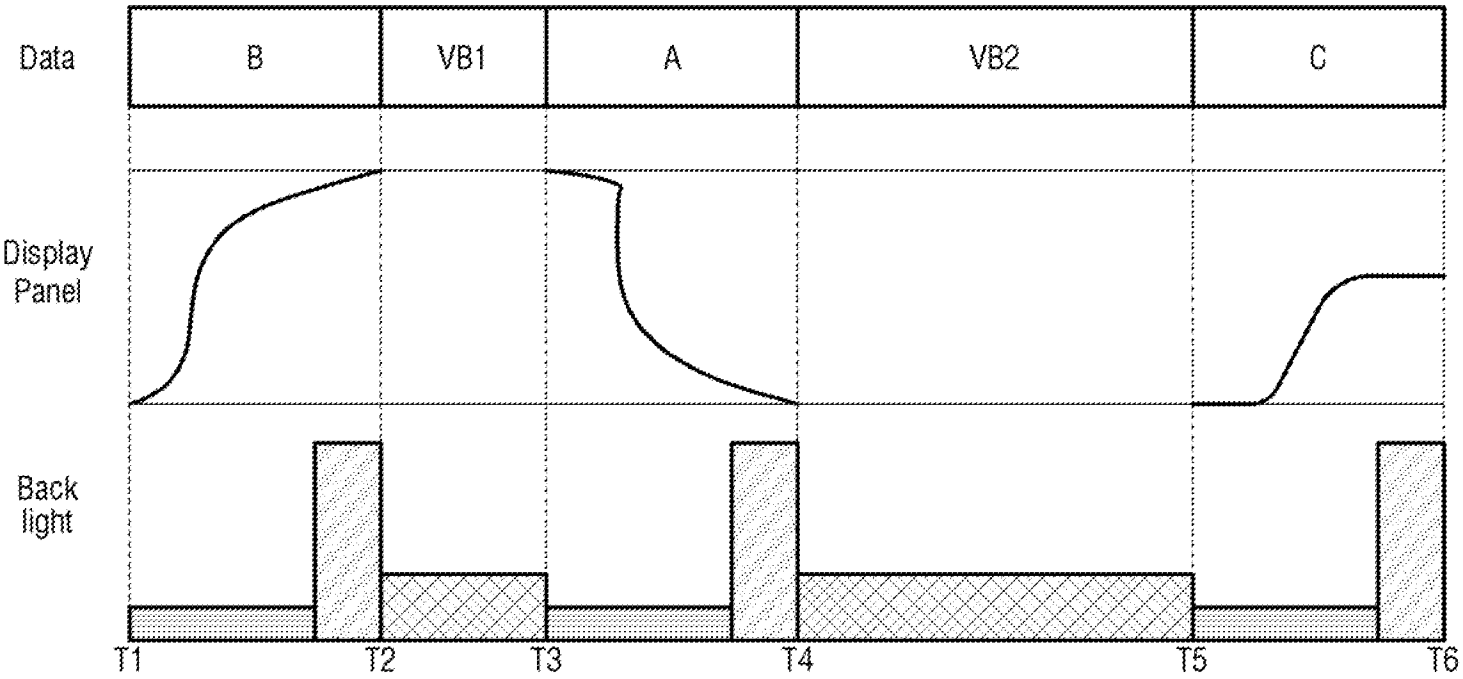
FIG. 18 is a diagram for explaining a data output figure of the display panel according to an operation of a backlight unit according to another embodiment of the present disclosure.

FIG. 18 is a diagram for explaining a data output figure of the display panel according to an operation of a backlight unit according to another embodiment of the present disclosure.

Referring to FIG. 18, the backlight unit 600 according to another embodiment of the present disclosure may irradiate the display panel 400 with strobe light at the active section from which data is output, and may additionally irradiate the first flat light having a brightness value different from that of the second flat light of the variable blank section, at the section between the start time of the active section and the irradiation time of the strobe light (hereinafter referred to as a scan type). By irradiating additional flat light at the active section, an occurrence of flicker can be further prevented.

Figure 19:
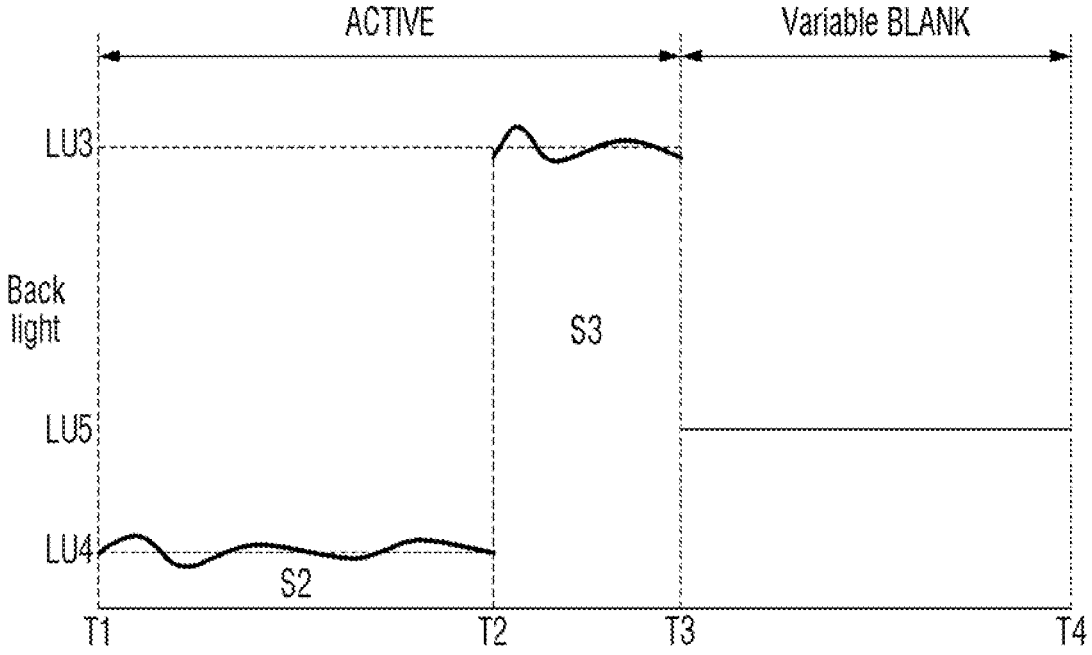
FIG. 19 is a diagram for explaining the brightness value of the flat light at the variable blank section according to another embodiment of the present disclosure.

FIG. 19 is a diagram for explaining the brightness value of the flat light at the variable blank section according to another embodiment.

Referring to FIG. 19, the backlight unit 600 may first irradiate the display panel 400 with the first flat light having a brightness value of LU4 at the active section during the time from T1 to T2. Subsequently, the backlight unit 600 may irradiate the display panel 400 with strobe light having a brightness value of LU3 during the time from T2 to T3. The brightness value of LU3 may be greater than the brightness value of LU4.

As a result, LU5, which is the brightness value of the second flat light irradiated at the variable blank section, may be determined by the following Formula.

$$LU5 = \frac{S2 + S3}{T3 - T1} \quad \text{[Formula 3]}$$

Here, T1 is a start time of the active section, T2 is an irradiation start time of strobe light at the active section, and T3 is an end time of the active section. Further, S2 may be a total amount by which the display panel 400 is irradiated with the first flat light having the brightness value of LU4 from T1 to T2, and S3 may be a total amount by which the display panel 400 is irradiated with the strobe light having the brightness value of LU3 from T2 to T3. In other words, the brightness value of the flat light at the variable blank section may have the same value as the average brightness value of the entire active section.

On the other hand, the brightness value of the first flat light and the brightness value of the strobe light may not be constant as shown. Therefore, LU5, which is the brightness value of the second flat light, may be expressed again as follows.

$$LU5 = \frac{\int_{T1}^{T2} L_2(t)dt + \int_{T2}^{T3} L_3(t)dt}{T3 - T1} \quad \text{[Formula 4]}$$

Here, $L_2(t)$ may be a brightness value function relating to the time of the first flat light, and $L_3(t)$ may be a brightness value function relating to the time of the strobe light.

Figure 20:
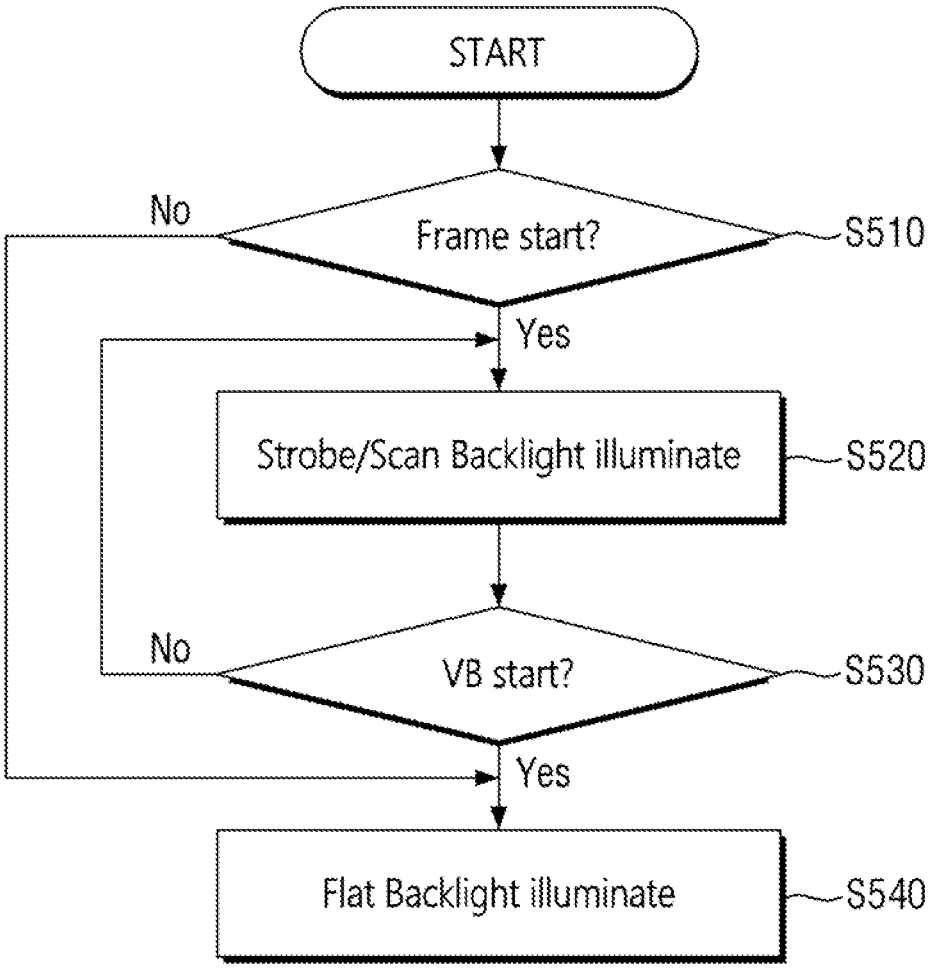
FIG. 20 is a flowchart for explaining the operating method of the backlight controller and the backlight unit according to an embodiment of the present disclosure.

FIG. 20 is a flowchart for explaining the operating method of the backlight controller and the backlight unit according to an embodiment of the present disclosure.

First, the display device 10 may receive input of the variable frame data DATA_IN and the variable frame synch signal Sgn_VFS. Accordingly, the backlight controller 500 may receive the backlight controller control signal CONT_BC generated on the basis of the variable frame synch signal Sgn_VFS. Start of a new variable frame may be the same as the start of the active section of the new variable frame (S510).

When the variable frame starts, the backlight unit 600 may irradiate the display panel 400 with light in a strobe type or a scan type. The backlight controller 500 may adjust the current level or duty ratio of the backlight unit signal supplied to the backlight unit 600 to drive the backlight unit 600 (S520).

When the active section of the variable frame ends, the variable blank section may start. In other words, the end time of the active section may be the same as the start time of the variable blank section (S530).

When the variable blank section starts, the backlight unit 600 may irradiate the display panel 400 with light in a flat type. The backlight controller 500 may adjust the current level or duty ratio of the backlight unit signal supplied to the backlight unit 600 so that the brightness value of the flat light irradiated by the backlight unit 600 is equal to the average brightness value of the active section (S540).

Figure 21:
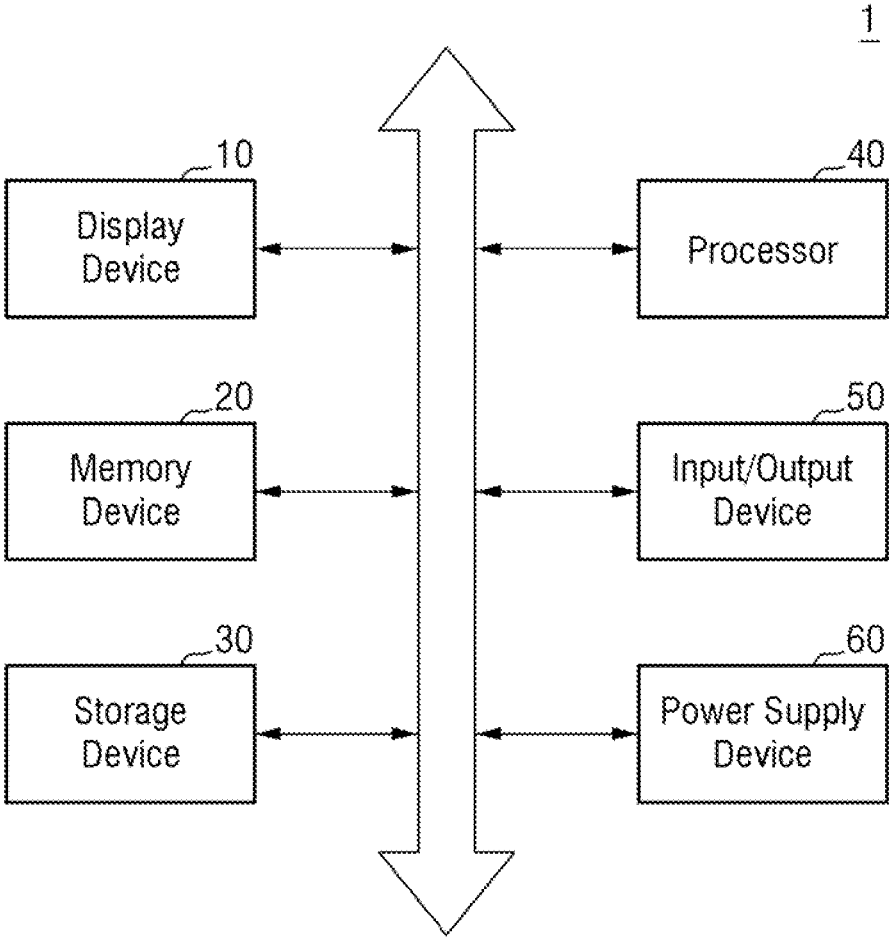
FIG. 21 is a block diagram showing an electronic device including a display device according to an embodiment of the present disclosure.

FIG. 21 is a block diagram showing an electronic device including a display device according to an embodiment of the present disclosure.

Referring to FIG. 21, the electronic device 1 may include a display device 10, a memory device 20, a storage device 30, a processor 40, an input/output device 50, and a power supply device 60. The electronic device 1 may further include a plurality of ports that may communicate with other systems.

The display device 10 may irradiate different lights at the active section and the variable blank section existing in the variable frame data to output an image which is clear and does not generate flicker.

The memory device 20 may store data necessary for the operation of the electronic device 1. For example, the memory device 20 may include a non-volatile memory device such as an EPROM (Erasable Programmable Read-Only Memory), an EEPROM (Electrically Erasable Programmable Read-Only Memory), a flash memory, a PRAM (Phase Change Random Access Memory), and a RRAM (Resistance Random Access Memory) or a volatile memory device such as a DRAM (Dynamic Random Access Memory) or a SRAM (Static Random Access Memory).

The storage device 30 may include a solid state drive (SSD), a hard disk drive (HDD), a CD-ROM, and the like.

The processor 40 may perform a particular calculation or task. The processor 40 may be a microprocessor, a central processing unit (CPU), or the like. The processor 40 may be connected to other components through a bus or the like.

The input/output device 50 may include input elements such as a keyboard, a keypad, a touch pad, a touch screen, and a mouse, and output elements such as a speaker and a printer.

The power supply device 60 may supply the electric power required for the operation of the electronic device 1.

In some embodiments of the present disclosure, the electronic device 1 may be any electronic device 1 including the display device 10, such as a digital TV (digital television), a three-dimensional (3D) TV, a personal computer (PC), a household electronic device, a laptop computer, a tablet computer, a mobile phone, a smart phone, a personal digital assistant (PDA), a portable multimedia player (PMP), a digital camera, a music player, a portable game console, and a navigation system.

In concluding the detailed description, those skilled in the art will appreciate that many variations and modifications may be made to the disclosed embodiments without departing from the principles of the present disclosure. Therefore, the disclosed embodiments of the disclosure are used in a descriptive sense and not for purposes of limitation.

What is claimed is:

1. A display device, comprising:

a display panel which includes a plurality of pixels, and outputs image data in an active section of a frame, and does not output image data in a blank section of the frame; and a backlight unit configured to irradiate the display panel with light, wherein a length of the blank section is variable, and the backlight unit is configured to irradiate the display panel with strobe light at the active section, and is configured to irradiate the display panel with a first flat light at the blank section, wherein the first flat light is continuously turned on throughout the blank section and has a constant brightness in the blank section.

2. The display device of claim 1, further comprising:

a processing unit configured to receive a variable frame synch signal to generate an internal control signal, wherein the variable frame synch signal determines a start time and an end time of the blank section.

3. The display device of claim 2, wherein the internal control signal includes:

a data driver control signal which controls a data driver, a gate driver control signal which controls a gate driver, and a backlight controller control signal which controls a backlight controller, wherein the internal control signal synchronizes the data driver, the gate driver, and the backlight controller.

4. The display device of claim 1, wherein the display device further comprises:

a backlight controller configured to control the backlight unit, wherein the backlight controller includes:

an identifying unit configured to receive a backlight controller control signal, identifying the active section and the blank section, and output a voltage control signal, a voltage generator configured to receive the voltage control signal and output voltage signals of different levels, and a backlight driver configured to receive the voltage signals and output a backlight unit signal having different levels of current from each other.

5. The display device of claim 4, wherein in response to the voltage signal being the active section, the backlight driver is configured to output a first backlight unit signal, the backlight unit is configured to receive the first backlight unit signal and irradiate the display panel with the strobe light, in response to the voltage signal being the blank section, the backlight driver is configured to output a second backlight unit signal, and the backlight unit is configured to receive the second backlight unit signal and irradiate the display panel with the flat light.

6. The display device of claim 5, wherein a current level of the second backlight unit signal is lower than a current level of the first backlight unit signal.

7. The display device of claim 1, wherein the display device further includes a backlight controller configured to control the backlight unit, and the backlight controller includes:

an identifying unit configured to receive a backlight controller control signal, identifying the active section and the blank section, and output a clock control signal, a clock generator configured to receive the clock control signal and output clock signals having different duty ratios from each other, and a backlight driver configured to receive the clock signals and output a backlight unit signal having different duty ratios.

8. The display device of claim 7, wherein in response to a first one of the clock signals being the active section, the backlight driver is configured to output a third backlight unit signal, the backlight unit is configured to receive the third backlight unit signal and irradiate the display panel with the strobe light, and in response to a second one of the clock signals being the blank section, the backlight driver is configured to output a fourth backlight unit signal, and the backlight unit is configured to receive the fourth backlight unit signal and irradiate the display panel with the flat light.

9. The display device of claim 8, wherein a duty ratio of the fourth backlight unit signal is smaller than a duty ratio of the third backlight unit signal.

10. The display device of claim 7, wherein the backlight controller further includes a strobe timing unit configured to output a strobe timing control signal, the backlight controller is further configured to provide a strobe timing signal to the backlight unit on the basis of the strobe timing control signal, and the backlight unit is configured to receive the strobe timing signal to adjust brightness of the display panel.

11. The display device of claim 1, wherein brightness of the first flat light is equal to a value of an average brightness of the entire active section.

12. The display device of claim 1, wherein the backlight unit is further configured to irradiate the display panel with second flat light from a start time of the active section to an irradiation time of the strobe light.

13. A display device, comprising:

a display panel including a plurality of pixels;

a backlight unit configured to irradiate the display panel with light;

a data driver configured to provide a data signal to the display panel;

a gate driver configured to provide a gate signal to the display panel;

a backlight controller configured to control the backlight unit; and a processing unit configured to receive input data and variable frame synch signal and generate an internal control signal and an output data, wherein the backlight controller is configured to provide the backlight unit with a backlight unit signal having a first current level at an active section of a variable frame, and the backlight controller is configured to provide the backlight unit with a backlight unit signal having a second current level lower than the first c level at a variable blank section of the variable frame, wherein the second current level is constant throughout the variable blank section.

14. The display device of claim 13, wherein the variable frame sync signal determines a start time and an end time of the variable blank section, and the internal control signal generated on the basis of the variable frame synch signal synchronizes the data driver, the gate driver, and the backlight controller.

15. The display device of claim 13, wherein the backlight controller comprises:

an identifying unit configured to receive a backlight controller control signal, identify the active section and the variable blank section, and output a voltage control signal, a voltage generator configured to receive the voltage control signal and output voltage signals having different levels from each other, and a backlight driver configured to receive the voltage signals and output the backlight unit signal of the first current level and the backlight unit signal of the second current level.

16. The display device of claim 15, wherein the backlight unit is configured to receive the backlight unit signal of the first current level, and irradiate a strobe light at the active section, and the backlight unit is configured to receive the backlight unit signal of the second current level and irradiate a flat light at the variable blank section.

17. A display device, comprising:

a display panel including a plurality of pixels;

a backlight unit configured to irradiate the display panel with light;

a data driver configured to provide a data signal to the display panel;

a gate driver configured to provide a gate signal to the display panel;

a backlight controller configured to control the backlight unit; and a processing unit configured to receive input data and a variable frame synch signal and generate an internal control signal and output data, wherein the backlight controller is configured to provide the backlight unit with a backlight unit signal having a first duty ratio at an active section of a variable frame, and the backlight controller is configured to provide the backlight unit with a backlight unit signal having a second duty ratio lower than the first duty ratio at a variable blank section of the variable frame, and wherein the backlight unit is configured to irradiate a flat light, which is continuously turned on throughout the blank section and has a constant brightness, at the variable blank section.

18. The display device of claim 17, wherein the variable frame sync signal determines a start time and an end time of the variable blank section, and the internal control signal generated on the basis of the variable frame synch signal synchronizes the data driver, the gate driver, and the backlight controller.

19. The display device of claim 17, wherein the backlight controller comprises:

an identifying unit configured to receive a backlight controller control signal, identify the active section and the variable blank section, and output a clock control signal, a clock generator configured to receive the clock control signal and output clock signals having different duty ratios from each other, and a backlight driver configured to receive the clock signal, and output a backlight unit signal of the first duty ratio and a backlight unit signal of the second duty ratio.

20. The display device of claim 19, wherein the backlight unit is configured to receive the backlight unit signal of the first duty ratio, and irradiate a strobe light at the active section, and the backlight unit is configured to receive the backlight unit signal of the second duty ratio and irradiate the flat light at the variable blank section.

* * * * *